US007898509B2

(12) United States Patent
Iida et al.

(10) Patent No.: US 7,898,509 B2
(45) Date of Patent: Mar. 1, 2011

(54) PIXEL CIRCUIT, DISPLAY, AND METHOD FOR DRIVING PIXEL CIRCUIT

(75) Inventors: Yukihito Iida, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 737 days.

(21) Appl. No.: 11/984,815

(22) Filed: Nov. 21, 2007

(65) Prior Publication Data

US 2008/0158110 A1 Jul. 3, 2008

(30) Foreign Application Priority Data

Dec. 27, 2006 (JP) ..... 2006-352560

(51) Int. Cl.
*G09G 3/30* (2006.01)

(52) U.S. Cl. ..... 345/76; 345/77; 345/80

(58) Field of Classification Search ..... 345/76–84, 345/204–215, 690–699
See application file for complete search history.

(56) References Cited

U.S. PATENT DOCUMENTS 7,023,408 B2 * 4/2006 Chen et al. ..... 345/82
2008/0007499 A1 * 1/2008 Kawabe ..... 345/82

FOREIGN PATENT DOCUMENTS

| | | | |
|---|---|---|---|
| JP | 2003-186437 | A | 7/2003 |
| JP | 2003-271095 | A | 9/2003 |
| JP | 2004-295131 | A | 10/2004 |
| JP | 2005-189643 | A | 7/2005 |
| JP | 2006-215213 | | 8/2006 |
| JP | 2007-148128 | A | 6/2007 |

OTHER PUBLICATIONS

Japanese Office Action issued Oct. 21, 2010 for corresponding Japanese Application No. 2006-352560.

* cited by examiner

*Primary Examiner*—Vijay Shankar
(74) *Attorney, Agent, or Firm*—Rader, Fishman & Grauer PLLC

(57) ABSTRACT

There is provided a display including: a pixel array part configured to include pixel circuits arranged in a matrix, each of the pixel circuits having a drive transistor, a holding capacitor, an electro-optical element, a sampling transistor, and an initialization transistor, a drive current based on information held in the holding capacitor being produced by the drive transistor and being applied to the electro-optical element for light emission of the electro-optical element; and a controller configured to include a write scanner, a horizontal driver, and an initialization scanner.

19 Claims, 17 Drawing Sheets

PIXEL CIRCUIT, DISPLAY, AND METHOD FOR DRIVING PIXEL CIRCUIT

CROSS REFERENCES TO RELATED APPLICATIONS

The present invention contains subject matter related to Japanese Patent Application JP 2006-352560 filed in the Japan Patent Office on Dec. 27, 2006, the entire contents of which being incorporated herein by reference.

BACKGROUND OF THE INVENTION

1. Field of the Invention

The present invention relates to a pixel circuit (referred to also as a pixel) including an electro-optical element (referred to also as a display element and a light-emitting element), a display having a pixel array part in which the pixel circuits are arranged in a matrix, and a method for driving the pixel circuit. More specifically, the invention relates to a pixel circuit having as a display element an electro-optical element of which luminance changes depending on the magnitude of a drive signal, an active-matrix display in which each pixel circuit has active elements and driving for displaying is carried out by the active elements on a pixel-by-pixel basis, and a method for driving the pixel circuit.

2. Description of the Related Art

There have been developed displays that employ, as display elements for pixels, electro-optical elements of which luminance changes depending on voltage applied thereto or current flow therethrough. For example, a liquid crystal display element is a representative example of electro-optical elements of which luminance changes depending on voltage applied thereto, and an organic electro luminescence (hereinafter, referred to as organic EL) element (organic light emitting diode (OLED)) is a representative example of electro-optical elements of which luminance changes depending on current flow therethrough. An organic EL display employing the organic EL elements is a so-called self-luminous display that employs self-luminous electro-optical elements as display elements for pixels.

The organic EL element is an electro-optical element employing a phenomenon that an organic thin film emits light when an electric field is applied thereto. The organic EL element is a low power consumption element because it can be driven by comparatively low application voltage (e.g., 10 V or lower). Furthermore, because the organic EL element is a self-luminous element that emits light by itself, it does not need an assistant illumination member such as a backlight, which is required in a liquid crystal display, and thus can easily achieve reduction in the display weight and thickness. Moreover, the response speed of the organic EL element is very high (e.g., several microseconds), and therefore no image lag occurs in displaying of a moving image. Because of these advantages, development of flat self-luminous displays employing the organic EL elements as electro-optical elements is being actively promoted in recent years.

As the driving system of displays including electro-optical elements typified by liquid crystal displays including liquid crystal display elements and organic EL displays including organic EL elements, a simple (passive)-matrix system or active-matrix system can be employed. However, a display of the simple-matrix system involves e.g. a problem that it is difficult to realize a large-size and high-definition display although the configuration thereof is simple.

For that reason, in recent years, development is being actively promoted on displays of the active-matrix system in which a pixel signal supplied to a light-emitting element inside the pixel is controlled by using an active element such as an insulated gate field effect transistor (typically, thin film transistor (TFT)) provided inside the pixel as a switching transistor.

In the active-matrix display, for light emission of an electro-optical element in a pixel circuit, an input image signal supplied via a video signal line is loaded through the switching transistor into a holding capacitor (referred to also as a pixel capacitor) provided for the gate (control input terminal) of a drive transistor, so that a drive signal dependent upon the loaded input image signal is supplied to the electro-optical element.

In the case of a liquid crystal display including liquid crystal display elements as electro-optical elements, the liquid crystal display element is a voltage-driven element and therefore is driven by a voltage signal itself dependent upon the input image signal loaded in the holding capacitor. In contrast, in an organic EL display that employs current-driven elements such as organic EL elements as electro-optical elements, a drive signal (voltage signal) dependent upon the input image signal loaded in the holding capacitor is converted to a current signal by a drive transistor, so that the drive current is supplied to the organic EL element or the like.

In the case of current-driven electro-optical elements typified by organic EL elements, if the drive current value differs, the light emission luminance also differs. Therefore, for light emission with stable luminance, it is vital to supply a stable drive current to an electro-optical element. For example, the driving systems for supplying a drive current to an organic EL element can be roughly classified into a constant-current driving system and a constant-voltage driving system (publicly-known documents thereof are not shown here, because these systems are well-known techniques).

The voltage-current characteristic of an organic EL element is a steep-slope characteristic. Therefore, in the case of the constant-voltage driving, even slight variation in the voltage and element characteristics causes large variation in the current, resulting in large variation in the luminance. Consequently, the constant-current driving in which the drive transistor is used in its saturation region is generally employed. Although current variation causes luminance variation also in the constant-current driving of course, small current variation causes only small luminance variation.

Conversely, even in the constant-current driving system, it is important that a drive signal written and held in the holding capacitor depending on an input image signal be constant in order to ensure invariant light emission luminance of an electro-optical element. For example, in order to ensure invariant light emission luminance of an organic EL element, it is important that the drive current dependent upon an input image signal be constant.

However, variation in the threshold voltage and the mobility of the active element (drive transistor) for driving an electro-optical element is caused by variation in the process for the active element. Furthermore, characteristics of the electro-optical element such as an organic EL element change over time. If there are such variation in characteristics of the drive active element and change in characteristics of the electro-optical element, the light emission luminance is adversely affected even in the constant-current driving system.

To address this problem and achieve uniform light emission luminance across the entire screen of a display, various studies have been made about schemes for correcting luminance variation attributed to the above-described variation in characteristics of the drive active element and the electro-optical element in each pixel circuit.

For example, in Japanese Patent Laid-open No. 2006-215213 (Patent Document 1), the following functions have been proposed as functions of a pixel circuit for an organic EL element; a threshold correction function for keeping a drive current constant even when the threshold voltage of the drive transistor involves variation and change over time; a mobility correction function for keeping a drive current constant even when the mobility of the drive transistor involves variation and change over time; and a bootstrap function for keeping a drive current constant even when the current-voltage characteristic of the organic EL element involves change over time.

However, the scheme described in Patent Document 1 requires, as additional components, interconnects for supplying potentials for the correction, two switching transistors for the correction, and two kinds of switching pulses for driving these switching transistors. As a result, this scheme has a 5TR-drive configuration employing five transistors, including a drive transistor and sampling transistor, and hence the configuration of the pixel circuit is complicated. Because the number of components in the pixel circuit is large, enhancement in the definition of the display is precluded. As a result, it is difficult for the 5TR-drive configuration to be applied to a display used in a small electronic apparatus such as a portable apparatus (mobile apparatus).

Therefore, there is a need for the development of a system that suppresses luminance variation due to variation in element characteristics with a simplified pixel circuit. This development should be so made that a new problem that is not involved by the 5TR-drive configuration but accompanies the simplification will not occur.

SUMMARY OF THE INVENTION

There is a general need for the present invention to provide a scheme that allows enhancement in the definition of a display through simplification of a pixel circuit.

Furthermore, there is a need for the invention to, particularly preferably, provide a scheme that can suppress luminance variation due to variation in element characteristics with a simplified pixel circuit. In particular, it is preferable for the invention to provide a scheme that can alleviate the influence on the image quality by the operation for driving a pixel circuit (particularly, suppress luminance unevenness).

According to one embodiment of the present invention, there is provided a display that causes electro-optical elements in pixel circuits to emit light based on video signals. In the display, each of the pixel circuits arranged in a matrix in a pixel array part includes at least a drive transistor that produces a drive current, a holding capacitor connected between the control input terminal (typically, the gate) and the output terminal (typically, the source) of the drive transistor, the electro-optical element connected to the output terminal of the drive transistor, and a sampling transistor that writes information corresponding to the signal potential of a video signal in the holding capacitor. In the pixel circuit, the drive current based on the information held in the holding capacitor is produced by the drive transistor and is applied to the electro-optical element for the light emission of the electro-optical element.

Because the sampling transistor writes the information corresponding to the signal potential to the holding capacitor, the sampling transistor captures the signal potential in its input terminal (one of its source and drain) and writes the information corresponding to the signal potential to the holding capacitor connected to its output terminal (the other of its source and drain). Of course, the output terminal of the sampling transistor is connected also to the control input terminal of the drive transistor.

The above-described connection configuration of the pixel circuit is the most basic configuration. As long as the pixel circuit includes at least the above-described respective components, other components also may be included in the pixel circuit. Furthermore, the expression "connection" encompasses not only direct connection but also indirect connection with the intermediary of another component.

For example, to a connection part, modification such as provision of a switching transistor or another component having a certain function is often added according to need. Typically, in order to dynamically control a displaying period (in other words, non-light-emission period), a switching transistor is often disposed between the output terminal of the drive transistor and the electro-optical element, or between the power supply terminal (typically, the drain) of the drive transistor and a power supply line as an interconnect for supplying power.

The pixel circuit having such a modified form is also encompassed by the pixel circuit for realizing the display according to one embodiment of the present invention as long as it can realize the configuration and the operation described in the present section (SUMMARY OF THE INVENTION).

In addition, as a peripheral part for driving the pixel circuits, e.g. a controller is provided that includes a write scanner for sequentially controlling the sampling transistors with a horizontal cycle to thereby carry out line-sequential scanning of the pixel circuits and writing information corresponding to the signal potential of the video signal to each of the holding capacitors on one row.

Preferably, the controller is further provided with a horizontal driver that implements control so that the video signals of which potential is switched at least between a reference potential and the signal potential in each horizontal period in matching with the line-sequential scanning by the write scanner may be supplied to the sampling transistors.

Preferably, the controller implements control for execution of threshold correction operation for holding the voltage equivalent to the threshold voltage of the drive transistor in the holding capacitor by keeping the sampling transistor at the conductive state in the time zone during which the reference potential of the video signal is supplied to the sampling transistor.

This threshold correction operation is repeatedly carried out in plural periods having a cycle of one horizontal period and each preceding the writing of the signal potential to the holding capacitor, according to need. This expression "according to need" means that there is a case in which the voltage equivalent to the threshold voltage of the drive transistor can not be held in the holding capacitor sufficiently in a threshold correction period in one horizontal period. By carrying out the threshold correction operation plural times, the voltage equivalent to the threshold voltage of the drive transistor is surely held in the holding capacitor.

More preferably, before the threshold correction operation, the controller implements control for execution of threshold correction preparation operation (charging operation and initialization operation) of setting the control input terminal of the drive transistor to the reference potential and setting the output terminal thereof to a second potential by keeping the sampling transistor at the conductive state in the time zone during which the voltage corresponding to the second potential is supplied to the power supply terminal of the drive transistor and the reference potential is supplied to the input terminal (one of the source and the drain) of the sampling transistor. That is, before the threshold correction operation, the potentials of the control input terminal and the output terminal of the drive transistor are so initialized that the potential difference between these terminals becomes the threshold voltage or higher.

More preferably, after the threshold correction operation, in the writing of the information of the signal potential to the holding capacitor through keeping of the sampling transistor at the conductive state in the time zone during which the voltage corresponding to a first potential is supplied to the drive transistor and the signal potential is supplied to the sampling transistor, the controller implements control so that a voltage for correction of the mobility of the drive transistor may be added to the signal written to the holding capacitor.

In this operation, the sampling transistor is kept at the conductive state for a period that falls within the time zone during which the signal potential is supplied to the sampling transistor and hence is shorter than this time zone.

More preferably, the controller stops supply of the video signal to the control input terminal of the drive transistor by turning the sampling transistor to the non-conductive state at the timing when the information corresponding to the signal potential has been written to the holding capacitor, to thereby allow bootstrap operation in which the potential of the control input terminal of the drive transistor changes in linkage with change in the potential of the output terminal of the drive transistor.

Preferably, the controller carries out the bootstrap operation also at the beginning of light emission start after the sampling operation, in particular. Specifically, the controller turns the sampling transistor to the non-conductive state after turning the sampling transistor to the conductive state in the state in which the signal potential is supplied to the sampling transistor, to thereby keep constant the potential difference between the control input terminal and the output terminal of the drive transistor.

Furthermore, preferably, the controller controls the bootstrap operation to realize operation for correcting change in the electro-optical element over time in a light emission period. For this purpose, the controller continuously keeps the sampling transistor at the non-conductive state in the period during which the drive current based on the information held in the holding capacitor flows through the electro-optical element, to thereby allow the constantly-keeping of the voltage between the control input terminal and the output terminal so that the operation for correcting change in the electro-optical element over time can be realized.

As a feature of the pixel circuit and the display according to one embodiment of the present invention, based on the pixel circuit having the above-described configuration, an initialization transistor that initializes the potential of the output terminal of the drive transistor based on a predetermined initialization potential is further provided. In order to control this initialization transistor, the controller is further provided with an initialization scanner that outputs an initialization scan pulse for controlling each of the initialization transistors on one row in matching with the line-sequential scanning by the write scanner.

Furthermore, the sampling transistor is used not only as a transistor for writing information corresponding to the signal potential to the holding capacitor but also as an initialization transistor for initializing the potential of the control input terminal of the drive transistor based on the initialization potential. In order for the sampling transistor to function as an initialization transistor, the write scanner adjusts the on/off timings of the write drive pulse.

Furthermore, preferably, the horizontal driver sets, besides the reference potential and the signal potential, an initialization potential for the initialization operation (as a potential preceding the reference potential, for example). The horizontal driver implements control so that the video signal of which potential is sequentially switched between the initialization potential and the signal potential (and the reference potential for precharging to the video signal line and threshold correction, preferably) in each horizontal period in matching with the line-sequential scanning by the write scanner may be supplied to the sampling transistor and the initialization transistor. The purpose of this feature is to prevent an increase in the number of interconnects by allowing the video signal line to serve also as an interconnect for supplying the initialization potential to the sampling transistor and the initialization transistor.

This feature eliminates the need to modify the configuration relating to connection lines of the sampling transistor for the pixel circuit having the above-described configuration. The input terminal (one of the drain and the source) of the initialization transistor is connected to the video signal line, and the output terminal (the other of the drain and the source) thereof is coupled to the connecting node between the holding capacitor and the output terminal of the drive transistor. To the control input terminal (gate) thereof, the initialization scan pulse from the initialization scanner is supplied.

The controller implements control for execution of operation (referred to as preparation operation for threshold correction operation) of initializing the potentials of the control input terminal and the output terminal of the drive transistor by keeping the sampling transistor and the initialization transistor at the conductive state in the time zone during which the initialization potential is supplied to the sampling transistor and the initialization transistor, before the threshold correction operation for holding the voltage equivalent to the threshold voltage of the drive transistor in the holding capacitor.

According to one embodiment of the present invention, the initialization transistor for initializing the potential of the output terminal of the drive transistor based on the initialization potential is further provided. Furthermore, the sampling transistor is used not only as a transistor for signal writing but also as an initialization transistor for initializing the potential of the control input terminal of the drive transistor based on the initialization potential.

Due to these features, for provision of a function to correct the mobility of the drive transistor for an active-matrix display in which current-driven electro-optical elements such as organic EL elements are used in pixel circuits, initialization operation as preparation operation for the threshold correction can be carried out while increase in the numbers of transistors and interconnects is suppressed to the minimum relating to the initialization transistor.

Through the minimum modification for the pixel circuit including the drive transistor and the sampling transistor, a display offering a favorable image quality can be realized without the influence of variation in the threshold voltage. It is more preferable that the pixel circuit have a function to correct the mobility of the drive transistor and a function to correct change in the electro-optical element over time (bootstrap function). This feature can provide a higher image quality.

This is because the light emission luminance can be kept constant without the influence of changes and variations in the threshold and the mobility of the drive transistor by correcting the threshold variation by the threshold correction function and correcting the mobility variation by the mobility correction function. Furthermore, this is because constant light emission luminance can be always kept because the potential difference between the control input terminal and the output terminal of the drive transistor is kept constant by the bootstrap operation of the holding capacitor at the time of light emission even when the current-voltage characteristic of the electro-optical element changes over time.

For the realization of the function of threshold correction and the function of threshold correction preparation preceding the threshold correction (initialization function), the addition of the initialization transistor, the control of the initialization transistor, and the use of the sampling transistor also as an initialization transistor effectively function.

Specifically, if the initialization transistor is added and the sampling transistor and the initialization transistor are controlled in linkage with supply of the initialization potential for incorporation of the threshold correction function, increase in the numbers of switching transistors for threshold correction (and initialization for preparation of the threshold correction) and scan lines for controlling the control input terminals of the transistors can be suppressed to the minimum. Thus, the pixel circuit can be simplified compared with the 5TR-drive configuration described in Patent Document 1.

In particular, if the video signal line is used also as an interconnect for supplying the initialization potential to the sampling transistor and the initialization transistor and control is so implemented that the video signal of which potential is sequentially switched between the initialization potential and the signal potential is supplied to the sampling transistor and the initialization transistor, there is no need to provide a dedicated interconnect for the initialization potential, and therefore the effect of the pixel circuit simplification is enhanced.

That is, it is sufficient to add modification specific to the present invention based on the 2TR-drive configuration. Therefore, the numbers of components and interconnects in the pixel circuit can be reduced compared with the 5TR-drive configuration. This allows reduction in the area of the pixel array part, which makes it easy to achieve enhancement in the definition of a display. Thus, with a simplified pixel circuit, the function to correct luminance variation due to variations in characteristics of the elements can be realized.

DETAILED DESCRIPTION OF THE PREFERRED EMBODIMENTS

An embodiment of the present invention will be described in detail below with reference to the accompanying drawings.

<Outline of Entire Display>

Figure 1:
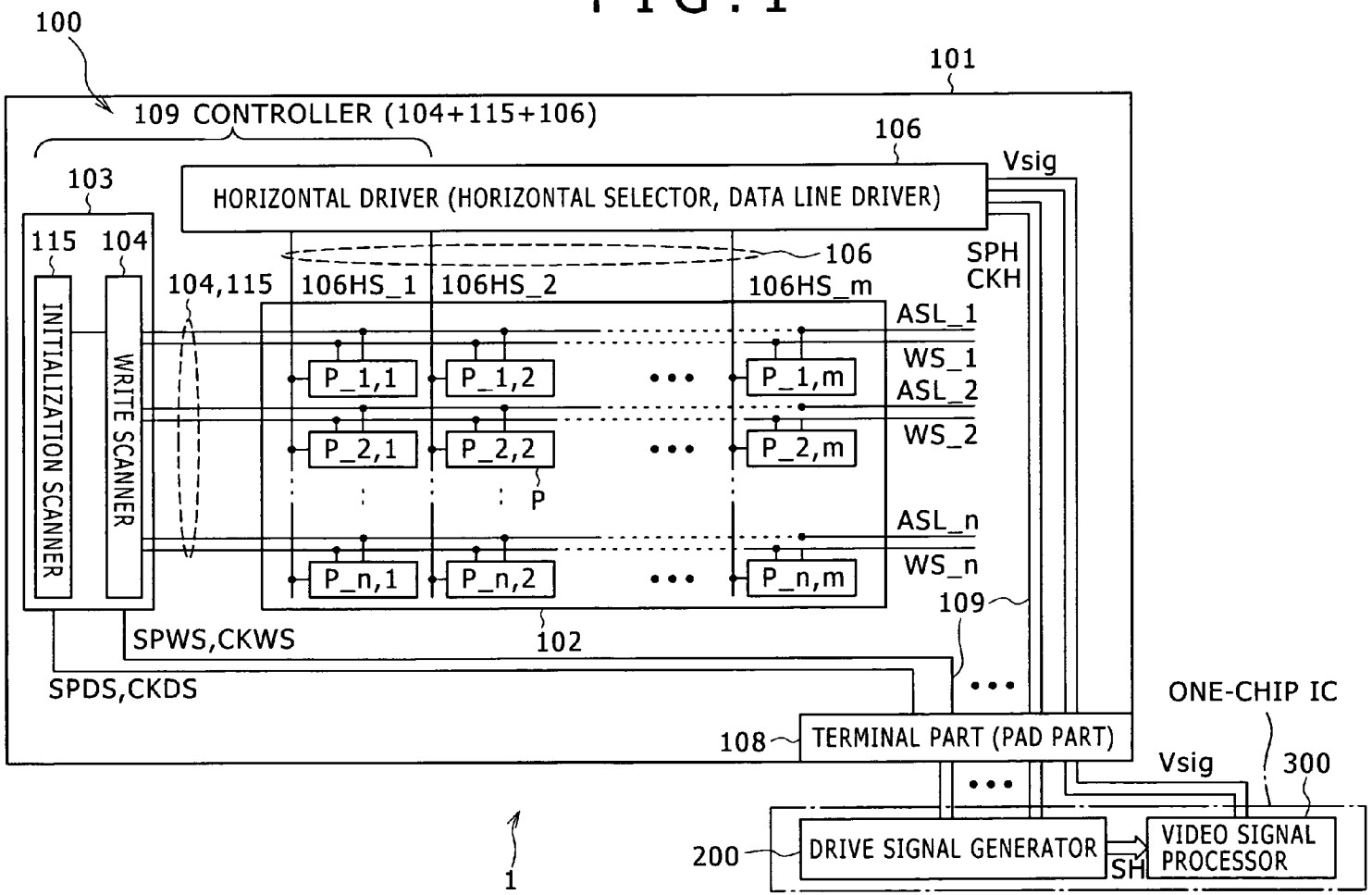
FIG. 1 is a block diagram schematically showing the configuration of an active-matrix display according to one embodiment of the present invention.

FIG. 1 is a block diagram schematically showing the configuration of an active-matrix display according to one embodiment of the present invention. The following description will deal with an example in which the present embodiment is applied to an active-matrix organic EL display (hereinafter, referred to as an "organic EL display") obtained by forming organic EL elements as display elements (electro-optical elements, light-emitting elements) for pixels on a semiconductor substrate on which poly-silicon thin film transistors (TFTS) are formed as active elements.

The organic EL elements used as display elements for pixels in the following specific description are merely one example, and the display elements are not limited to the organic EL elements. All of the embodiment to be described below can be similarly applied to all of general display elements that emit light by being driven based on current.

Referring to FIG. 1, an organic EL display 1 includes a display panel part 100, a drive signal generator 200 as one example of a panel controller that generates various kinds of pulse signals for driving and controlling this display panel part 100, and a video signal processor 300. In the display panel part 100, pixel circuits (referred to also as pixels) P having organic EL elements (not shown) as plural display elements are so arranged as to form an effective video area having a horizontal-to-vertical ratio of X:Y (e.g., 9:16) as its display aspect ratio. The drive signal generator 200 and the video signal processor 300 are incorporated in one-chip semiconductor integrate circuit (IC).

The product form of the organic EL display 1 is not limited to the module (composite part) form including all of the display panel part 100, the drive signal generator 200, and the video signal processor 300 like that in the drawing. For example, it is also possible to provide only the display panel part 100 as the organic EL display 1. Such an organic EL display 1 is utilized as a display unit in portable music players employing a recording medium such as a semiconductor memory, mini disc (MD), or cassette tape, and other electronic apparatuses.

For the display panel part 100, a pixel array part 102 in which the pixel circuits P are arranged in a matrix of n rows×m columns, a vertical driver 103 for vertically scanning the pixel circuits P, a horizontal driver (referred to also as a horizontal selector or data line driver) 106 for horizontally scanning the pixel circuits P, and a terminal part (pad part) 108 for external connection are integrally formed on a substrate 101. That is, peripheral drive circuits such as the vertical driver 103 and the horizontal driver 106 are formed on the same substrate 101 as that for the pixel array part 102.

The vertical driver 103 and the horizontal driver 106 form a controller 109 that controls writing of a signal potential to a holding capacitor, threshold correction operation, mobility correction operation, and bootstrap operation.

The vertical driver 103 includes e.g. a write scanner (WSCN) 104 and an initialization scanner (auto zero scanner (ASCN)) 115 that carries out row-scanning of preparatory operation (initialization operation (referred to also as auto-zero operation)) for threshold correction operation to be described later.

As one example, the pixel array part 102 is driven by the write scanner 104 and the initialization scanner 115 from one or both of the left and right sides in the drawing, and is driven by the horizontal driver 106 from one or both of the upper and lower sides in the drawing.

To the terminal part 108, various pulse signals are supplied from the drive signal generator 200 disposed outside the organic EL display 1. Furthermore, a video signal Vsig is supplied thereto from the video signal processor 300 similarly.

For example, as pulse signals for vertical driving, requisite pulse signals such as shift start pulses SPDS and SPWS as one example of vertical writing start pulses, and vertical scan clocks CKDS and CKWS are supplied. Furthermore, as pulse signals for horizontal driving, requisite pulse signals such as a horizontal start pulse SPH as one example of horizontal writing start pulses, and a horizontal scan clock CKH are supplied.

The respective terminals of the terminal part 108 are connected via interconnects 109 to the vertical driver 103 and the horizontal driver 106. For example, the respective pulses supplied to the terminal part 108 are subjected to internal voltage-level adjustment by a level shifter (not shown) according to need, followed by being supplied via a buffer to the respective units in the vertical driver 103 and the horizontal driver 106.

In the pixel array part 102, although not shown in the drawing (details will be described later), the pixel circuits P in which pixel transistors are provided for an organic EL element as a display element are two-dimensionally arranged on rows and columns. For this pixel arrangement, scan lines are provided on a row-by-row basis and signal lines are provided on a column-by-column basis.

For example, for the pixel array part 102, scan lines (gate lines) 104WS and video signal lines (data lines) 106HS are formed. At the intersection between the lines, an organic EL element and thin film transistors (TFTs) for driving it (both are not shown) are formed. The pixel circuit P is formed based on the combination between the organic EL element and the thin film transistors.

Specifically, for the respective pixel circuits P arranged in a matrix, write scan lines 104WS_1 to 104WS_n for n rows driven based on a write drive pulse WS by the write scanner 104 and initialization scan lines 115ASL_1 to 115ASL_n for n rows driven based on an initialization scan pulse ASL by the initialization scanner 115 are provided for each pixel row.

The write scanner 104 and the initialization scanner 115 sequentially select the respective pixel circuits P via the write scan lines 104WS and the initialization scan lines 115ASL, based on vertical driving pulse signals supplied from the drive signal generator 200. For the selected pixel circuits P, the horizontal driver 106 allows predetermined potentials of a video signal Vsig to be sampled and written to holding capacitors via the video signal lines 106HS, based on a horizontal driving pulse signal supplied from the drive signal generator 200.

In the organic EL display 1 of the present embodiment, only line-sequential driving is possible. Specifically, the write scanner 104 and the initialization scanner 115 in the vertical driver 103 scan the pixel array part 102 in a line-sequential manner (i.e., on a row-by-row basis). In synchronization with this scanning, the horizontal driver 106 writes image signals for one horizontal line to the pixel array part 102 simultaneously.

For example, for matching with the line-sequential driving, the horizontal driver 106 is provided with a driver circuit for simultaneously turning on switches (not shown) provided on the video signal lines 106HS on all the columns. Thus, the horizontal driver 106 simultaneously turns on the switches provided on the video signal lines 106HS on all the columns so that pixel signals input from the video signal processor 300 can be simultaneously written to all the pixel circuits P on one row selected by the vertical driver 103.

For matching with the line-sequential driving, the respective units in the vertical driver 103 are formed based on a combination of logic gates (including also latches), and select the pixel circuits P in the pixel array part 102 on a row-by-row basis. Although FIG. 1 shows the configuration in which the vertical driver 103 is disposed on only one side of the pixel array part 102, it is also possible to dispose the vertical drivers 103 on both of the left and right sides of the pixel array part 102.

Similarly, although FIG. 1 shows the configuration in which the horizontal driver 106 is disposed on only one side of the pixel array part 102, it is also possible to dispose the horizontal drivers 106 on both of the upper and lower sides of the pixel array part 102.

<Pixel Circuit>

Figure 2:
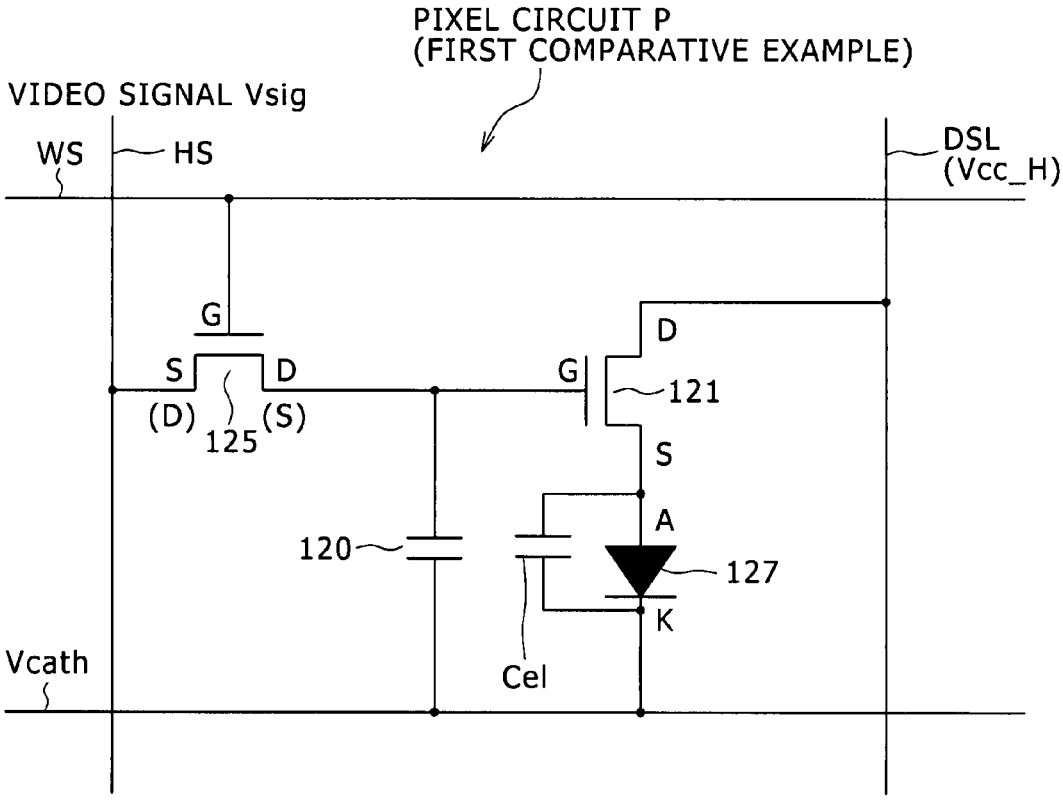
FIG. 2 is a diagram showing a comparative example for a pixel circuit of the embodiment.
Figure 3:
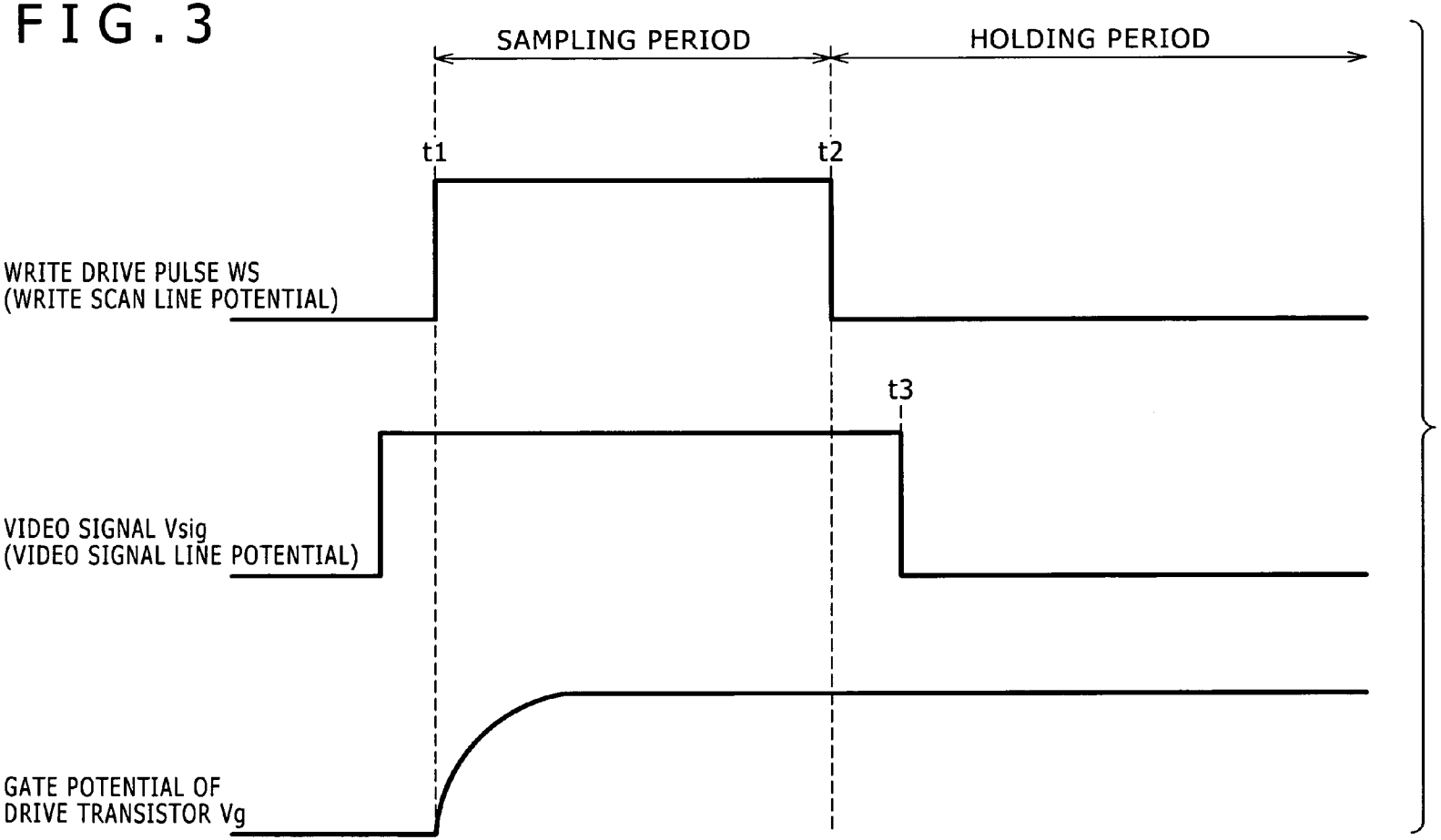
FIG. 3 is a timing chart for explaining the operation of the comparative example shown in FIG. 2 and a pixel circuit of an organic EL display.

FIG. 2 is a diagram showing a comparative example for the pixel circuit P of the present embodiment. FIG. 2 shows also the vertical driver 103 and the horizontal driver 106, which are provided in the periphery of the pixel circuits P on the substrate 101 of the display panel part 100. FIG. 3 is a timing chart for explaining the operation of the comparative-example pixel circuit P shown in FIG. 2. FIG. 4 is a diagram for explaining the influence on a drive current Ids due to variation in characteristics of an organic EL element 127 and a drive transistor 121. FIGS. 4D through 4H are diagrams for explaining the concept of a scheme for eliminating the influence.

Figure 5:
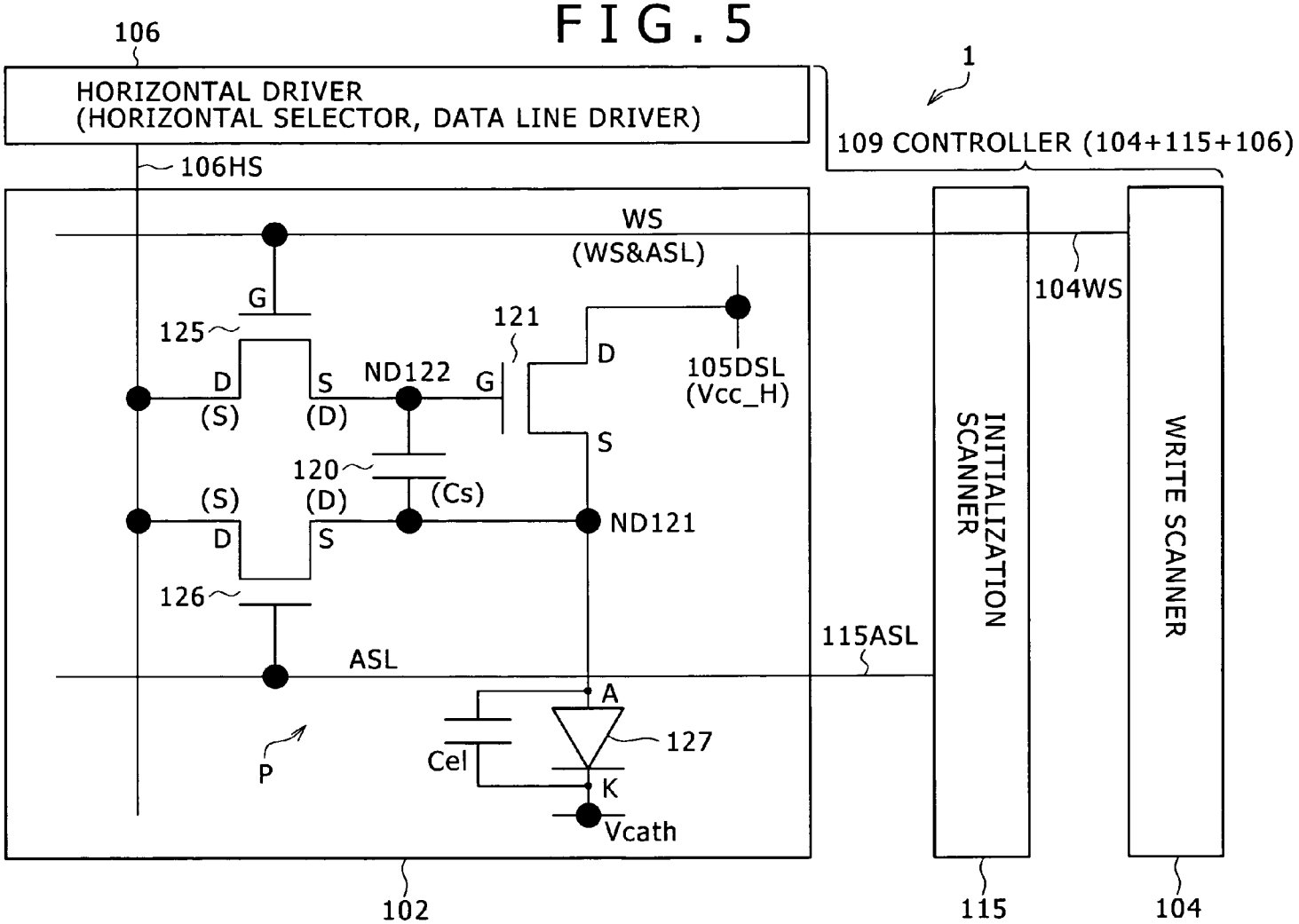
FIG. 5 is a diagram showing a pixel circuit and an organic EL display of the embodiment.

FIG. 5 is a diagram showing the pixel circuit P and the organic EL display 1 of the present embodiment. FIG. 5 shows also the vertical driver 103 and the horizontal driver 106, which are provided in the periphery of the pixel circuits P on the substrate 101 of the display panel part 100.

A feature of the pixel circuit P of the present embodiment is that a drive transistor is formed of an n-channel thin film field effect transistor basically. Furthermore, as another feature, the pixel circuit P is provided with a circuit for suppressing variation in the drive current Ids to an organic EL element due to the deterioration of the organic EL element over time, i.e., a drive-signal constantly-keeping circuit for correcting change in the current-voltage characteristic of the organic EL element as one example of electro-optical elements to thereby keep the drive current Ids constant. In addition, the pixel circuit P is characteristically provided with a function to keep the drive current constant even when the current-voltage characteristic of the organic EL element has changed over time.

If the drive transistor can be formed by using an n-channel transistor instead of a p-channel transistor, an existing amorphous silicon (a-Si) process can be used for transistor fabrication. This allows reduction in the cost of the transistor substrate, and therefore development of the pixel circuit P having such a configuration is expected.

MOS transistors are used as the respective transistors typified by the drive transistor. In this case, the gate of the drive transistor is treated as a control input terminal. Either one of the source and drain (source, in the present embodiment) of the drive transistor is treated as an output terminal, and the other (drain, in the present embodiment) is treated as a power supply terminal.

<Pixel Circuit of Comparative Example>

Initially, for comparison with features of the pixel circuit P of the present embodiment, the comparative-example pixel circuit P shown in FIG. 2 will be described below. The organic EL display 1 that includes the comparative-example pixel circuits P in its pixel array part 102 will be referred to as the comparative-example organic EL display 1.

The comparative-example pixel circuit P is the same as that of the present embodiment in that the drive transistor is formed of an n-channel thin film field effect transistor basically. However, the pixel circuit P of the comparative example is not provided with a drive-signal constantly-keeping circuit for preventing the influence on the drive current Ids due to the deterioration of the organic EL element 127 over time.

Specifically, the pixel circuit P includes the n-channel drive transistor 121, an n-channel sampling transistor 125, and the organic EL element 127 as one example of electro-optical elements that emit light in response to current flow therethrough. The organic EL element 127 generally has a rectification function, and therefore is represented by a diode symbol. The organic EL element 127 involves a parasitic capacitor Cel. In FIG. 2, this parasitic capacitor Cel is disposed in parallel to the organic EL element 127.

The drain D of the drive transistor 121 is connected to a power supply line DSL for supplying a first supply potential, and the source (output terminal) S thereof is connected to the anode A of the organic EL element 127. The cathode K of the organic EL element 127 is connected to a ground line Vcath (GND) that supplies a reference potential and is common to all the pixels.

The source S of the sampling transistor 125 is connected to a video signal line HS, and the drain D thereof is connected to the gate (control input terminal) G of the drive transistor 121. Between this connecting node and a reference line for supplying a second supply potential, a holding capacitor 120 is provided. In this configuration, the reference line for supplying the second supply potential is the same as the ground line Vcath for supplying the reference potential for the organic EL element 127. Alternatively, this reference line may supply a different potential.

Although not shown in the drawing, in the case of a 3TR configuration arising from addition of a light-emission control transistor that controls a light emission period, the source of the drive transistor 121 is connected to the drain D of the n-channel light-emission control transistor, and the source S of the light-emission control transistor is connected to the anode of the organic EL element 127, for example.

In this pixel circuit P, no matter whether or not the light-emission control transistor is provided, a source follower circuit is formed as a whole in driving of the organic EL element 127, because the drain D of the drive transistor 121 is connected to the first supply potential and the source S thereof is connected to the anode A of the organic EL element 127.

The timing chart of FIG. 3, for explaining the operation of the comparative-example pixel circuit P shown in FIG. 2, shows operation of sampling a valid-period potential (referred to as a signal potential) as a potential of the video signal Vsig supplied from the signal line HS (hereinafter, referred to also as a video signal line potential) and causing the organic EL element 127 as one example of light-emitting elements to enter the light emission state.

In the time zone (t1 to t4) during which the video signal line 106HS is at the signal potential corresponding to the valid period of the video signal Vsig, the potential of the write scan line WS is switched to the high level (t2). In response to this level switching, the n-channel sampling transistor 125 enters the on-state, so that the video signal line potential supplied from the signal line HS is charged in the holding capacitor 120. Due to this charging, the potential of the gate G of the drive transistor 121 (gate potential Vg) starts to rise, so that the drain current starts to flow. Thus, the anode potential of the organic EL element 127 rises up, so that light emission starts.

Thereafter, when the write drive pulse WS is switched to the low level (t3), the video signal line potential at this timing, i.e., the valid-period potential (signal potential) among the potentials of the video signal Vsig, is held in the holding capacitor 120. Due to this operation, the gate potential Vg of the drive transistor 121 becomes constant, and thus the light emission luminance is kept constant until the next frame (or field). The period from the timing t2 to the timing t3 corresponds to a sampling period for the video signal Vsig, and the period subsequent to the timing t3 corresponds to a holding period.

In the comparative-example pixel circuit P, the potential of the source S of the drive transistor 121 (source potential Vs) depends on the operating points of the drive transistor 121 and the organic EL element 127, and the voltage value differs depending on the gate potential Vg of the drive transistor 121.

In general, the drive transistor 121 is driven in its saturation region. The drive transistor 121 serves as a constant current source having a value shown in Equation (1), in which Ids denotes the current flowing between the drain and source of the transistor that operates in its saturation region, μ denotes the mobility, W denotes the channel width (gate width), L denotes the channel length (gate length), Cox denotes the gate capacitance (gate oxide film capacitance per unit area), and Vth denotes the threshold voltage of the transistor. As is apparent from Equation (1), the drain current Ids of the transistor is controlled by the gate-source voltage Vgs in the saturation region.

$$Ids = \frac{1}{2}\mu\frac{W}{L}Cox(Vgs - Vth)^2 \quad (1)$$

<Iel-Vel Characteristic and I-V Characteristic of Light-Emitting Element>

Figure 4A:
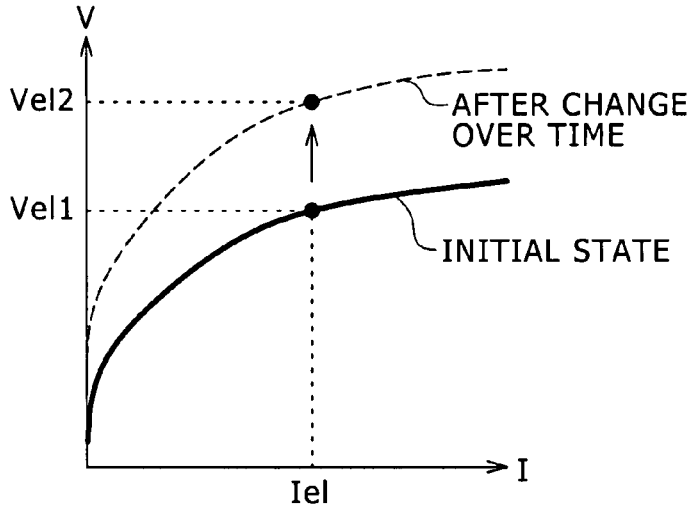
FIGS. 4A to 4C are diagrams for explaining the influence on a drive current due to variation in characteristics of an organic EL element and a drive transistor.

FIG. 4A shows the current-voltage (Iel-Vel) characteristics of a current-driven light-emitting element typified by an organic EL element. In FIG. 4A, the curve indicated by the full line represents the characteristic in the initial state, while the curve indicated by the dashed line represents the characteristic after change over time. In general, the I-V characteristic of a current-driven light-emitting element typified by an organic EL element deteriorates over time as shown in the graph.

For example, when the light emission current Iel flows through the organic EL element 127 as one example of light-emitting elements, the anode-cathode voltage Vel thereof is uniquely determined. As shown in FIG. 4A, during a light emission period, the light emission current Iel dependent upon the drain-source current Ids (=drive current Ids) of the drive transistor 121 flows through the anode A of the organic EL element 127, so that the anode-cathode voltage rises up by Vel.

In the comparative-example pixel circuit P, due to the change over time in the I-V characteristic of the organic EL element 127, the anode-cathode voltage Vel necessary for the same light emission current Iel changes from Vel1 to Vel2, so that the operating point of the drive transistor 121 changes. Thus, even when the same gate potential Vg is applied, the source potential Vs of the drive transistor 121 varies, and as a result, the gate-source voltage Vgs of the drive transistor 121 varies.

In a simple circuit in which an n-channel transistor is used as the drive transistor 121, the drive transistor 121 is affected by the change over time in the I-V characteristic of the organic EL element 127 because the source S thereof is connected to the organic EL element 127. Thus, the amount of the current (light emission current Iel) flowing through the organic EL element 127 varies. As a result, the light emission luminance varies.

Specifically, in the comparative-example pixel circuit P, the operating point varies due to the change over time in the I-V characteristic of the organic EL element 127. Therefore, the source potential Vs of the drive transistor 121 varies even when the same gate potential Vg is applied. Thus, the gate-source voltage Vgs of the drive transistor 121 varies. As is apparent from Equation (1), if the gate-source voltage Vgs varies, the drive current Ids varies even when the gate potential Vg is constant, and simultaneously the current flowing through the organic EL element 127 also varies. In the comparative-example pixel circuit P having the source follower configuration shown in FIG. 2, the light emission luminance of the organic EL element 127 changes over time if the I-V characteristic of the organic EL element 127 changes.

In a simple circuit in which an n-channel transistor is used as the drive transistor 121, the gate-source voltage Vgs changes along with the change in the organic EL element 127 over time because the source S is connected to the organic EL element 127. Thus, the amount of the current flowing through the organic EL element 127 varies. As a result, the light emission luminance varies.

The variation in the anode potential of the organic EL element 127, attributed to change over time in a characteristic of the organic EL element 127 as one example of light-emitting elements, appears as variation in the gate-source voltage Vgs of the drive transistor 121, and causes variation in the drain current (drive current Ids). This variation in the drive current appears as variation in the light emission luminance among the pixel circuits P, so that the deterioration of the image quality occurs.

In contrast, in the present embodiment, a circuit configuration for realizing a bootstrap function is employed and the circuit is driven at drive timings for bootstrap operation, as described in detail later. The bootstrap function is to link the gate potential Vg of the drive transistor 121 with the source potential Vs thereof by setting the sampling transistor 125 to the non-conductive state at the timing when information corresponding to a signal potential Vin has been written to the holding capacitor 120 (and during the subsequent light emission period of the organic EL element 127 continuously). Due to this feature, even when the anode potential of the organic EL element 127 varies (i.e., the source potential varies) attributed to change over time in a characteristic of the organic EL element 127, the uniformity of the screen luminance can be ensured by varying the gate potential Vg in such a way that this anode potential variation will be cancelled. The bootstrap function can enhance the ability for correcting change over time in a current-driven light-emitting element typified by an organic EL element.

This bootstrap function can be started at the timing of the light emission start, at which the write drive pulse WS is switched to the inactive-L state and thus the sampling transistor 125 is turned off. In addition, the bootstrap function works also during change in the source potential Vs of the drive transistor 121 in linkage with change in the anode-cathode voltage Vel in the process of the rising-up of the anode-cathode voltage Vel until its stable state along with the flowing of the light emission current Iel through the organic EL element 127 after the light emission start.

<Vgs-Ids Characteristic of Drive Transistor>

Due to variation in the manufacturing process for the drive transistor 121, there are variations among the pixel circuits P in characteristics such as the threshold voltage and the mobility. Even if the drive transistor 121 is driven in the saturation region, due to this characteristic variation, the drain current (drive current Ids) varies from pixel to pixel and this variation appears as variation in the light emission luminance, even when the same gate potential is applied to the drive transistor 121.

Figure 4B:
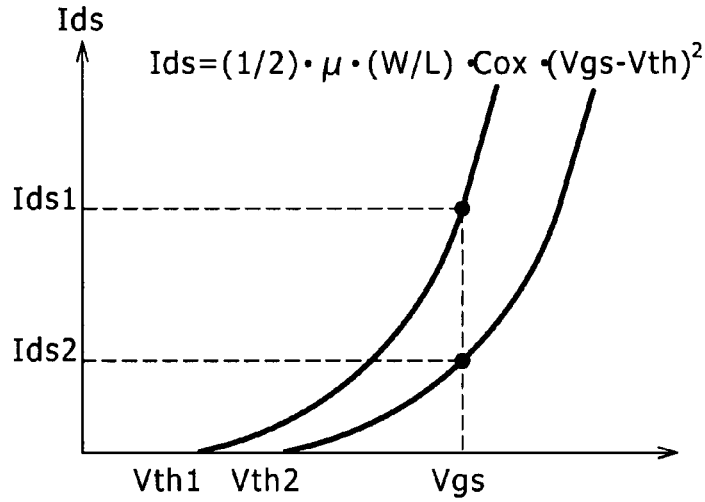

FIG. 4B is a diagram showing the voltage-current (Vgs-Ids) characteristics, with focus on variation in the threshold voltage of the drive transistor 121. In FIG. 4B, the characteristic curves of two drive transistors 121 having different threshold voltages of Vth1 and Vth2 are shown.

As described above, the drain current Ids when the drive transistor 121 operates in the saturation region is expressed by Equation (1). As is apparent from Equation (1), variation in the threshold voltage Vth leads to variation in the drain current Ids even when the gate-source voltage Vgs is constant. Specifically, unless any countermeasure is employed against the variation in the threshold voltage Vth, the drive current Ids varies as shown in FIG. 4B. More specifically, when the threshold voltage is Vth1, the drive current corresponding to Vgs is Ids1. In contrast, when the threshold voltage is Vth2, the drive current Ids2 corresponding to the same gate voltage Vgs is different from Ids1.

Figure 4C:
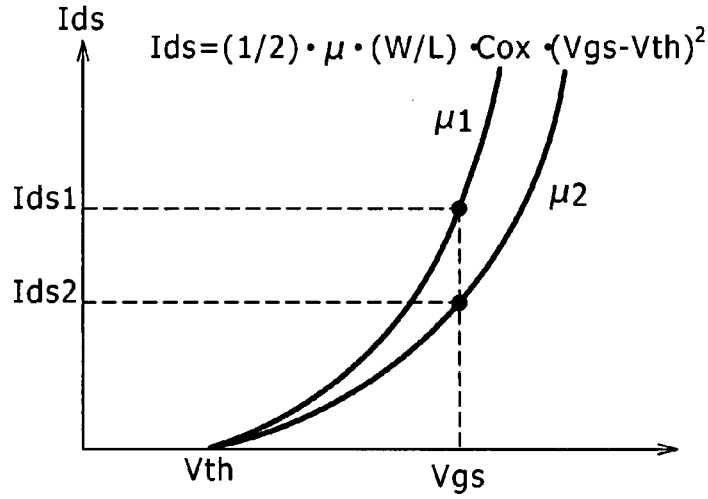

FIG. 4C is a diagram showing the voltage-current (Vgs-Ids) characteristics, with focus on variation in the mobility of the drive transistor 121. In FIG. 4C, the characteristic curves of two drive transistors 121 having different mobilities of μ1 and μ2 are shown.

As is apparent from Equation (1), variation in the mobility μ leads to variation in the drain current Ids even when the gate-source voltage Vgs is constant. Specifically, unless any countermeasure is employed against the variation in the mobility μ, the drive current Ids varies as shown in FIG. 4C. More specifically, when the mobility is μ1, the drive current corresponding to Vgs is Ids1. In contrast, when the mobility is p2, the drive current corresponding to the same gate voltage Vgs is Ids2 different from Ids1.

<Concept of Threshold Correction and Mobility Correction>

In contrast, by employing drive timings for realizing a threshold correction function and a mobility correction function (details thereof will be described later), the influence of variations in the threshold and the mobility can be suppressed, and thus the uniformity of the screen luminance can be ensured.

Through threshold correction operation and mobility correction operation in the present embodiment, the gate-source voltage Vgs at the time of light emission is set to a value expressed as "Vin+Vth−ΔV", as described in detail later. This prevents the drain-source current Ids from depending on variation and change in the threshold voltage Vth and depending on variation and change in the mobility μ. As a result, even if the threshold voltage Vth and the mobility μ vary due to variation in the manufacturing process and time elapse, the drive current Ids does not vary, and thus the light emission luminance of the organic EL element 127 also does not vary.

Figure 4D:
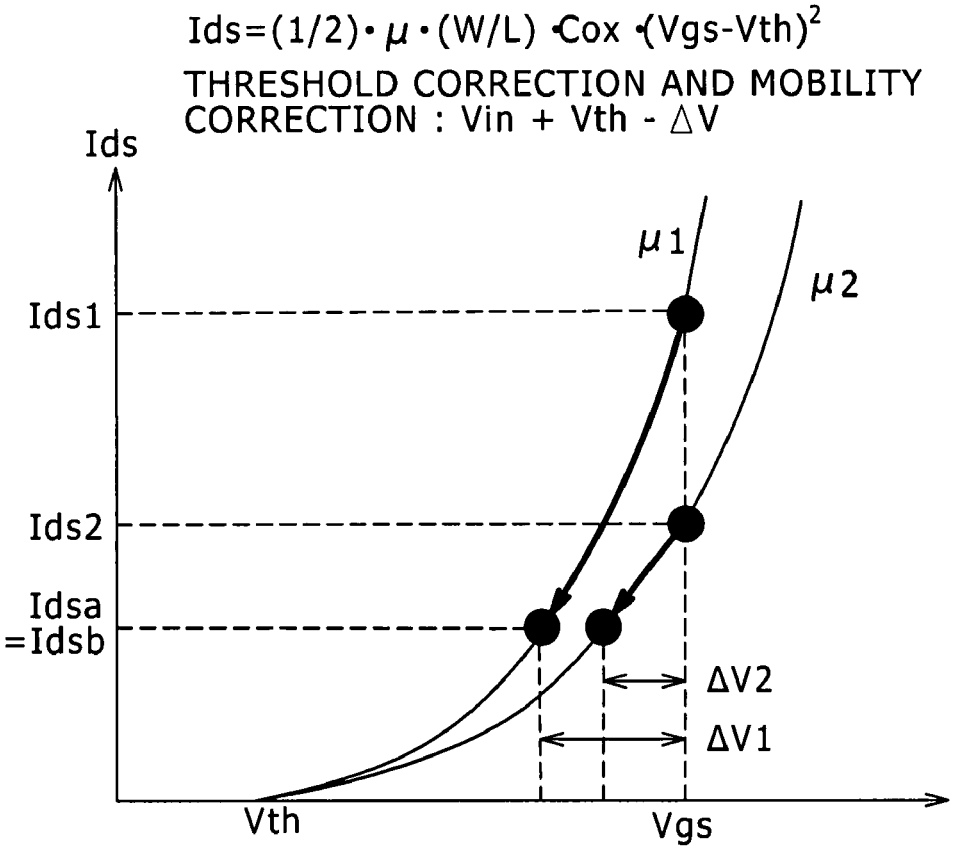
FIG. 4D is a diagram for explaining the concept of a scheme for eliminating the influence on a drive current due to variation in characteristics of a drive transistor.

FIG. 4D is a graph for explaining the operating point of the drive transistor 121 at the time of mobility correction. Specifically, against variation in the mobility (μ1 and μ2) due to variation in the manufacturing process and time elapse, threshold correction and mobility correction for setting the gate-source voltage Vgs at the time of light emission to a value expressed as "Vin+Vth−ΔV" are carried out. Due to this correction, regarding the mobility, a mobility correction parameter ΔV1 is determined for the mobility μ1, while a mobility correction parameter ΔV2 is determined for the mobility μ2.

Because a proper mobility correction parameter is determined for either mobility due to the correction, the drive current Idsa when the mobility of the drive transistor 121 is μ1 and the drive current Idsb when the mobility is μ2 are determined. In the optimum state, the relationship "Idsa=Idsb" is obtained, so that the difference in the mobility μ is cancelled.

If the mobility correction is not performed, also as shown in FIG. 4C, different mobilities μ1 and μ2 yield different drive currents Ids1 and Ids2 as the drive current Ids corresponding to the same gate-source voltage Vgs. To address this, the proper mobility correction parameters ΔV1 and ΔV2 are applied to the mobilities μ1 and μ2, respectively, which provides the drive currents Idsa and Idsb. Through optimization of the respective mobility correction parameters μV1 and ΔV2, the levels of the drive currents Idsa and Idsb resulting from the mobility correction can be equalized to each other.

At the time of the mobility correction, as is apparent from the graph of FIG. 4D, negative feedback is carried out in such a way that the mobility correction parameter ΔV1 for the high mobility μ1 is set large whereas the mobility correction parameter ΔV2 for the low mobility μ2 is set small. From this sense, the mobility correction parameter ΔV is referred to also as a negative feedback amount ΔV.

Figure 4E:
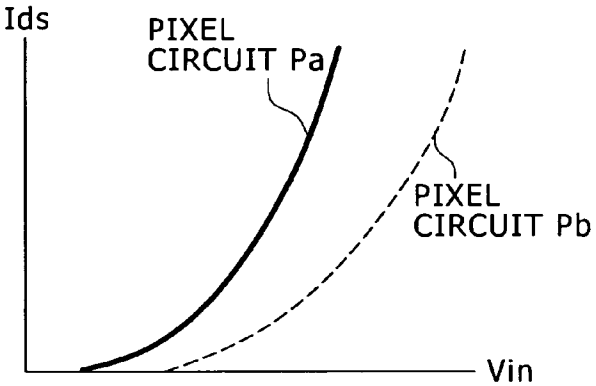
FIGS. 4E to 4H are diagrams for explaining the concept of the scheme for eliminating the influence on a drive current due to variation in characteristics of a drive transistor.

The respective diagrams of FIG. 4E show the relationships between the signal potential Vin and the drive current Ids in view of the threshold correction. In the respective diagrams of FIG. 4E, the current-voltage characteristic of the drive transistor 121 is shown with the signal potential Vin and the drive current Ids plotted on the abscissa and the ordinate, respectively. In each diagram, two characteristic curves are shown regarding a pixel circuit Pa (full line curve) including the drive transistor 121 having a comparatively low threshold voltage Vth and comparatively high mobility μ and a pixel circuit Pb (dotted line curve) including the drive transistor 121 having a comparatively high threshold voltage Vth and comparatively low mobility μ.

FIG. 4E shows the case in which neither threshold correction nor mobility correction is carried out. In this case, because correction of the threshold voltage Vth and the mobility μ is not carried out at all for the pixel circuits Pa and Pb, the Vin-Ids characteristics greatly differ from each other due to the differences in the threshold voltage Vth and the mobility. Accordingly, even when the same signal potential Vin is applied, the drive current Ids, i.e., the light emission luminance, varies, and hence the uniformity of the screen luminance is not achieved.

Figure 4F:
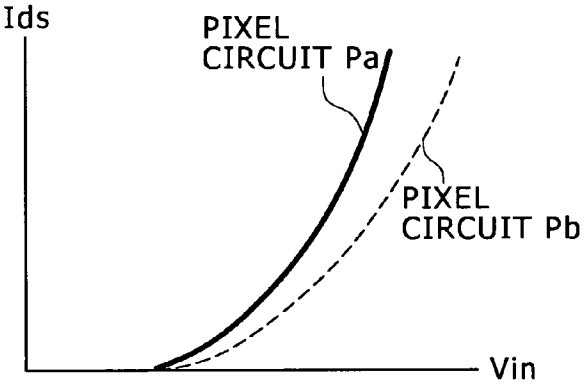

FIG. 4F shows the case in which threshold correction is carried out but mobility correction is not carried out. In this case, the difference in the threshold voltage Vth between the pixel circuits Pa and Pb is cancelled. However, the difference in the mobility μ appears as it is. Therefore, in the region of a higher signal potential Vin (i.e., region of higher luminance), the difference in the mobility μ appears more strongly, and the luminance varies even when the grayscale is the same. Specifically, when the grayscale is the same (the signal potential Vin is the same), the luminance (drive current Ids) of the pixel circuit Pa having high mobility μ is high, whereas the luminance of the pixel circuit Pb having low mobility μ is low.

Figure 4G:
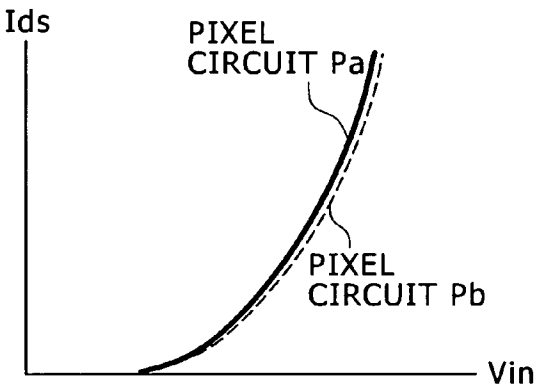

FIG. 4G shows the case in which both threshold correction and mobility correction are carried out. In this case, the differences in the threshold voltage Vth and the mobility μ are completely corrected. As a result, the Vin-Ids characteristics of the pixel circuits Pa and Pb correspond with each other. Therefore, the luminance (Ids) has the same level for all the grayscales (signal potentials Vin), so that the uniformity of the screen luminance is significantly improved.

Figure 4H:
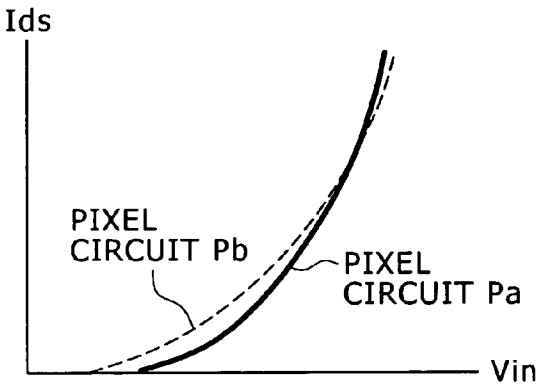

FIG. 4H shows the case in which both threshold correction and mobility correction are carried out but the correction of the threshold voltage Vth is insufficient. One example of this case is a situation in which the voltage equivalent to the threshold voltage Vth of the drive transistor 121 can not be sufficiently held in the holding capacitor 120 in one time of threshold correction operation. In this case, the difference in the threshold voltage Vth is not eliminated, which yields the difference in the luminance (drive current Ids) between the pixel circuits Pa and Pb in the low grayscale region. Therefore, when the correction of the threshold voltage Vth is insufficient, unevenness of the luminance appears at low grayscales and hence the image quality is deteriorated.

<Pixel Circuit of Embodiment>

FIG. 5 shows the pixel circuit P of the present embodiment. This pixel circuit P includes a circuit (bootstrap circuit) that prevents variation in the drive current due to the deterioration of the organic EL element 127 over time in the comparative-example pixel circuit P shown in FIG. 2. Furthermore, this pixel circuit P employs a driving scheme for preventing variation in the drive current due to variations in characteristics of the drive transistor 121 (variations in the threshold voltage and the mobility). The organic EL display 1 that includes the pixel circuits P of the present embodiment in its pixel array part 102 will be referred to as the present-embodiment organic EL display 1.

As a feature of the pixel circuit P of the present embodiment, the pixel circuit P has a 3TR-drive configuration that is obtained by adding, to the base 2TR-drive configuration employing the drive transistor 121 and one switching transistor (sampling transistor 125) for video signal write scanning, another one switching transistor (referred to as an initialization transistor 126) for initializing the potential of the source S of the drive transistor 121 as its output terminal as preparatory operation preceding threshold correction operation.

The initialization transistor 126 has a function to initialize the potential of the source S of the drive transistor 121 as its output terminal based on an initialization potential Vini of the video signal Vsig supplied via the video signal line 106HS. In the pixel circuit P of the present embodiment, the sampling transistor 125 has not only a function to write to the holding capacitor 120 the information corresponding to the signal potential Vin of the video signal Vsig supplied via the video signal line 106HS but also a function of an initialization transistor for initializing the potential of the gate G of the drive transistor 121 as its control input terminal based on the initialization potential Vini of the video signal Vsig supplied via the video signal line 106HS.

As a feature of the drive timings, in association with the addition of the initialization transistor 126, an initialization scan line 115ASL and an initialization scan pulse ASL are added to control the initialization transistor 126 so that the source S of the drive transistor 121 can be initialized. Furthermore, the on/off-timings of the write drive pulse WS are adjusted so that the sampling transistor 125 can function as an initialization transistor for initializing the gate G of the drive transistor 121. Virtually, the write scan line 104WS serves as a write and initialization scan line, and the write drive pulse WS serves as a write and initialization scan pulse WS and ASL.

As a feature of the video signal Vsig, in each one horizontal period, the signal potential Vin indicating the signal level and a reference potential Vo used also for precharging to the video signal line 106HS are set, and the initialization potential Vini for initialization is added as the potential preceding the reference potential Vo. Thereby, through setting of the on/off-timings of the initialization scan pulse ASL and the write drive pulse WS for controlling the respective switching transistors, the influence on the drive current Ids due to the deterioration of the organic EL element 127 over time and variations in characteristics of the drive transistor 121 (such as variations and changes in the threshold voltage and the mobility) is prevented.

The present-embodiment pixel circuit P has a 3TR-drive configuration and hence has smaller numbers of elements and interconnects compared with the 5TR-drive configuration described in Patent Document 1. This allows definition enhancement. Furthermore, sampling can be performed without the deterioration of the video signal vsig, which can provide a favorable image quality.

There are large configurational differences between the present-embodiment pixel circuit P and the comparative example shown in FIG. 2. First, in the present-embodiment pixel circuit P, the connection form of the holding capacitor 120 is modified, so that a bootstrap circuit as one example of drive-signal constantly-keeping circuits is constructed as a circuit for preventing variation in the drive current due to the deterioration of the organic EL element 127 over time.

Second, the present-embodiment pixel circuit P is provided with a 3TR-drive configuration arising from addition of the initialization transistor 126 for preparatory operation preceding threshold correction operation, as a scheme for suppressing the influence on the drive current Ids due to variations in characteristics of the drive transistor 121 (such as variations and changes in the threshold voltage and the mobility). Furthermore, the initialization scan line 115ASL and the initialization scan pulse ASL for controlling the initialization transistor 126 are added. In addition, the initialization potential Vini for the initialization is added as the potential preceding the reference potential Vo for the video signal Vsig, and the drive timings of the respective transistors 125 and 126 are inventively designed.

Specifically, the present-embodiment pixel circuit P includes the holding capacitor 120, the n-channel drive transistor 121, the n-channel sampling transistor 125 to which the active-H (high) write drive pulse WS is supplied, the n-channel initialization transistor 126 to which the active-H (high) initialization scan pulse ASL is supplied, and the organic EL element 127 as one example of electro-optical elements (light-emitting elements) that emit light in response to current flow therethrough.

The holding capacitor 120 is connected between the gate G (node ND122) and the source S of the drive transistor 121. The source S of the drive transistor 121 is connected directly to the anode A of the organic EL element 127. The cathode K of the organic EL element 127 is supplied with a cathode potential Vcath as a reference potential. This cathode potential Vcath is connected to a ground line Vcath (GND) that supplies the reference potential and is common to all the pixels, similarly to the comparative example shown in FIG. 2.

The drain D of the drive transistor 121 is connected to a power supply line 105DSL for supplying a supply potential. The power supply line 105DSL has an ability for supplying power to the drive transistor 121. In the present embodiment, the power supply line 105DSL supplies a supply voltage Vcc_H on the certain high voltage side to the drain D of the drive transistor 121.

The sampling transistor 125 is disposed at the intersection between the video signal line 106HS and the write scan line 104WS. The gate G of the sampling transistor 125 is connected to the write scan line 104WS from the write scanner 104. The drain D thereof is connected to the video signal line 106HS, and the source S thereof is coupled to the connecting node (node ND122) between the gate G of the drive transistor 121 and one terminal of the holding capacitor 120. To the gate G of the sampling transistor 125, the active-H write drive pulse WS is supplied from the write scanner 104. It is also possible for the sampling transistor 125 to have the connection form in which the source S and the drain D are interchanged. As the sampling transistor 125, either a depletion-type transistor or enhancement-type transistor can be used.

The initialization transistor 126 is disposed at the intersection between the video signal line 106HS and the initialization scan line 115ASL. The gate G of the initialization transistor 126 is connected to the initialization scan line 115ASL from the initialization scanner 115. The drain D thereof is connected to the video signal line 106HS, and the source S thereof is coupled to the connecting node (node ND121) between the source G of the drive transistor 121 and the other terminal of the holding capacitor 120. To the gate G of the initialization transistor 126, the active-H initialization scan pulse ASL is supplied from the initialization scanner 115.

It is also possible for the initialization transistor 126 to have the connection form in which the source S and the drain D are interchanged. It however is preferable that the connection form of the source S and the drain D of the initialization transistor 126 correspond with that of the sampling transistor 125.

As the initialization transistor 126, either a depletion-type transistor or enhancement-type transistor can be used. It however is preferable that the type of the initialization transistor 126 correspond with that of the sampling transistor 125.

<Operation of Pixel Circuit of Embodiment>

The drive timings for the pixel circuit P of the present embodiment are as follows. Initially, the sampling transistor 125 is turned on in response to the write drive pulse WS supplied from the write scan line 104WS, and samples the video signal Vsig supplied from the video signal line 106HS to hold it in the holding capacitor 120. This feature is basically the same as that in the driving of the comparative-example pixel circuit P shown in FIG. 2.

From the standpoint of sequential scanning based on the drive timings for the pixel circuit P of the present embodiment, in the writing of information of the signal potential Vin of the video signal Vsig to the holding capacitor 120, video signals for one row are simultaneously transmitted to the video signal lines 106 HS of the respective columns. That is, line-sequential driving is carried out.

The drive transistor 121 is supplied with a current from the supply voltage Vcc_H of the power supply line 105DSL to thereby apply the drive current Ids to the organic EL element 127 depending on the signal potential (the valid-period potential of the video signal Vsig) held in the holding capacitor 120.

The vertical driver 103 outputs the write drive pulse WS as a control signal for turning on the sampling transistor 125 in the time zone during which the video signal line 106HS is at the reference potential Vo corresponding to the invalid period of the video signal Vsig, to thereby hold the voltage equivalent to the threshold voltage Vth of the drive transistor 121 in the holding capacitor 120. This operation realizes a threshold correction function. The threshold correction function can cancel the influence of variation in the threshold voltage Vth of the drive transistor 121 among the pixel circuits P.

As drive timings for the pixel circuit P of the present embodiment, the vertical driver 103 repeatedly carries out the threshold correction operation in plural horizontal periods that each precede the sampling of the signal potential Vin of the video signal Vsig, to thereby surely hold the voltage equivalent to the threshold voltage Vth of the drive transistor 121 in the holding capacitor 120.

In the pixel circuit P of the present embodiment, by thus carrying out the threshold correction operation plural times, a sufficiently long writing time is ensured.

This makes it possible to surely hold the voltage equivalent to the threshold voltage Vth of the drive transistor 121 in the holding capacitor 120 in advance.

This held voltage equivalent to the threshold voltage Vth is used to cancel the threshold voltage Vth of the drive transistor 121. Therefore, even when there is variation in the threshold voltage Vth of the drive transistor 121 among the pixel circuits P, this variation is completely cancelled for all the pixel circuits P, which enhances the image uniformity, i.e., the uniformity of the light emission luminance across the entire screen of the display. In particular, luminance unevenness that tends to appear when the signal potential corresponds to a low grayscale can be prevented.

Preferably, before the threshold correction operation, in the time zone during which the video signal line 106HS is at the initialization potential Vini (<reference potential Vo) preceding the reference potential Vo corresponding to the invalid period of the video signal Vsig, the vertical driver 103 switches the write drive pulse WS to the active state (H level, in the present example) to thereby turn on the sampling transistor 125, and switches the initialization scan pulse ASL to the active state (H level, in the present example) to thereby turn on the initialization transistor 126. Thereafter, with the write drive pulse WS kept active-H, the vertical driver 103 switches the initialization scan pulse ASL to the inactive state (L level, in the present example) to thereby turn off the initialization transistor 126.

Due to this operation, the threshold correction operation is started after the gate G and the source S of the drive transistor 121 are set to the initialization potential Vini. This reset operation (initialization operation) for the gate potential and the source potential allows the subsequent threshold correction operation to be surely carried out.

The pixel circuit P of the present embodiment is provided with a mobility correction function in addition to the threshold correction function. Specifically, in order for the sampling transistor 125 to be in the conductive state in the time zone during which the video signal line 106HS is at the signal potential Vin corresponding to the valid period of the video signal Vsig, the vertical driver 103 keeps the write drive pulse WS supplied to the write scan line 104WS at the active state (H level, in the present example) for a period shorter than this time zone. By properly setting the active period of the write drive pulse WS (equivalent to both sampling period and mobility correction period), correction for the mobility μ of the drive transistor 121 is added to the signal potential Vsig simultaneously with the holding of the signal potential Vsig in the holding capacitor 120.

In particular, according to the drive timings for the pixel circuit P of the present embodiment, the write drive pulse WS is kept at the active state within the time zone during which the video signal Vsig is in the valid period, preferably. As a result, the mobility correction period (sampling period, too) is determined by the overlapping range between the active period of the write drive pulse WS and the time zone during which the video signal line 106HS is at the potential (signal line potential) corresponding to the valid period of the video signal Vsig. In particular, as a preferred mode of the present embodiment, the width of the active period of the write drive pulse WS is set small so that this active period falls within the time zone during which the video signal line 106HS is at the signal potential. Thus, the mobility correction period is determined by the write drive pulse WS eventually.

To be exact, the mobility correction period (sampling period, too) is equivalent to the period from the timing at which the sampling transistor 125 is turned on in response to the rising-up of the write drive pulse WS to the timing at which the sampling transistor 125 is turned off in response to the falling-down of the write drive pulse WS.

The outline of a discussion about uniformity along the horizontal direction of the screen, to be described in detail later, is as follows. Specifically, the mobility correction period is substantially the same both in the pixel circuit P remoter from the write scanner 104 (referred to as a remote-side pixel) and in the pixel circuit P closer to the write scanner 104 (referred to as a close-side pixel). Furthermore, there is no difference between these pixel circuits P also in the signal potential (sampling potential) sampled in the holding capacitor 120 by the sampling transistor 125. As a result, luminance differences along the horizontal direction of the screen do not appear. This suppresses shading (one example of luminance unevenness) along the horizontal direction and thus can realize a display offering a favorable image quality.

Furthermore, the outline of a discussion about uniformity along the vertical direction of the screen, to be described in detail later, is as follows. Specifically, there is almost no difference between upper-side and lower-side pixel circuits P in the sampling potential and the mobility correction period as long as the active period of the write drive pulse WS falls within the time zone during which the video signal line 106HS is at the signal potential (valid-period potential of the video signal Vsig). As a result, luminance differences along the vertical direction of the screen do not appear. This suppresses shading along the vertical direction and thus can realize a display offering a favorable image quality.

The pixel circuit P of the present embodiment is provided with also a bootstrap function. Specifically, at the timing when the signal potential Vin of the video signal Vsig is held in the holding capacitor 120, the write scanner 104 stops the application of the write drive pulse WS to the write scan line 104WS (i.e., switches the pulse WS to the inactive-L (low) state) and thus turns off the sampling transistor 125, to thereby electrically isolate the gate G of the drive transistor 121 from the video signal line 106HS.

The holding capacitor 120 is connected between the gate G and the source S of the drive transistor 121. Due to the effect by the holding capacitor 120, the gate potential Vg of the drive transistor 121 changes in linkage with the change of the source potential Vs thereof, which allows the gate-source voltage Vgs to be kept constant.

<Timing Chart>

FIG. 6 is a timing chart for explaining operation in writing of information of the signal potential Vin in the holding capacitor 120 by a line-sequential system, as one example of drive timings relating to the pixel circuit P of the present embodiment shown in FIG. 5. FIGS. 6B to 6I are diagrams for explaining the equivalent circuits and the operation states in the respective periods shown in the timing chart of FIG. 6.

In FIG. 6, the potential changes of the write scan line 104WS, the initialization scan line 115ASL, and the video signal line 106HS are shown, and the time axis of these potential changes is the same. Furthermore, in parallel to these potential changes, the changes of the gate potential Vg and the source potential Vs of the drive transistor 121 are also shown regarding one row (the first row, in FIG. 6).

Basically, the same driving of the write scan line 104WS and the initialization scan line 115ASL is carried out for each one row, with sequential delays each corresponding to one horizontal scanning period. The respective timings and signals in FIG. 6 are shown as the same timings and signals as those for the first row, irrespective of the processing-target row. When differentiation of rows is needed in the description, for timings and signals, the processing-target row is indicated by a reference numeral provided with a symbol "_" for the differentiation.

Regarding drive timings for the pixel circuit P of the present embodiment, the period during which the video signal Vsig is at the initialization potential Vini corresponding to the invalid period thereof is defined as the former part of one horizontal period. The period during which the video signal Vsig is at the reference potential Vo, which also corresponds to the invalid period and follows the initialization potential Vini, is defined as the middle part of one horizontal period. The period during which the video signal Vsig is at the signal potential Vin corresponding to the valid period thereof is defined as the latter part of one horizontal period.

In the present example, threshold correction operation is carried out only once. However, this feature is not essential. The threshold correction operation may be repeated plural times in such a way that the processing cycle thereof is one horizontal period.

The reason why one horizontal period is employed as the processing cycle of the threshold correction operation when the threshold correction operation is carried out plural times is because the threshold correction operation is carried out as follows. Specifically, for each row, before the sampling transistor 125 samples information of the signal potential Vin in the holding capacitor 120, initialization operation of setting the gate G and the source S of the drive transistor 121 to the initialization potential Vini is carried out previously to the threshold correction operation. After the initialization operation, as the threshold correction operation, the sampling transistor 125 is turned on in the time zone during which the video signal line 106HS is at the reference potential Vo to thereby hold the voltage equivalent to the threshold voltage Vth of the drive transistor 121 in the holding capacitor 120.

Therefore, the threshold correction period is shorter than one horizontal period inevitably. This possibly causes the case in which this short one threshold correction period is insufficient to hold the accurate voltage corresponding to the threshold voltage Vth in the holding capacitor 120 due to the capacitance Cs of the holding capacitor 120, the level of the second potential Vcc_L, and other factors. Consequently, it is preferable to carry out the threshold correction operation plural times. Specifically, by repeatedly carrying out the threshold correction operation in plural periods having a cycle of one horizontal period and each preceding the sampling of the signal potential Vin (signal writing) in the holding capacitor 120, the voltage equivalent to the threshold voltage Vth of the drive transistor 121 is surely held in the holding capacitor 120.

The operation for a certain row (the first row, in the present example) will be described below. In a light emission period B of the previous field before a timing t13A, the write drive pulse WS is inactive-L and thus the sampling transistor 125 is in the non-conductive state. Furthermore, the initialization scan pulse ASL is inactive-L and thus the initialization transistor 126 is in the non-conductive state.

Figure 6A:
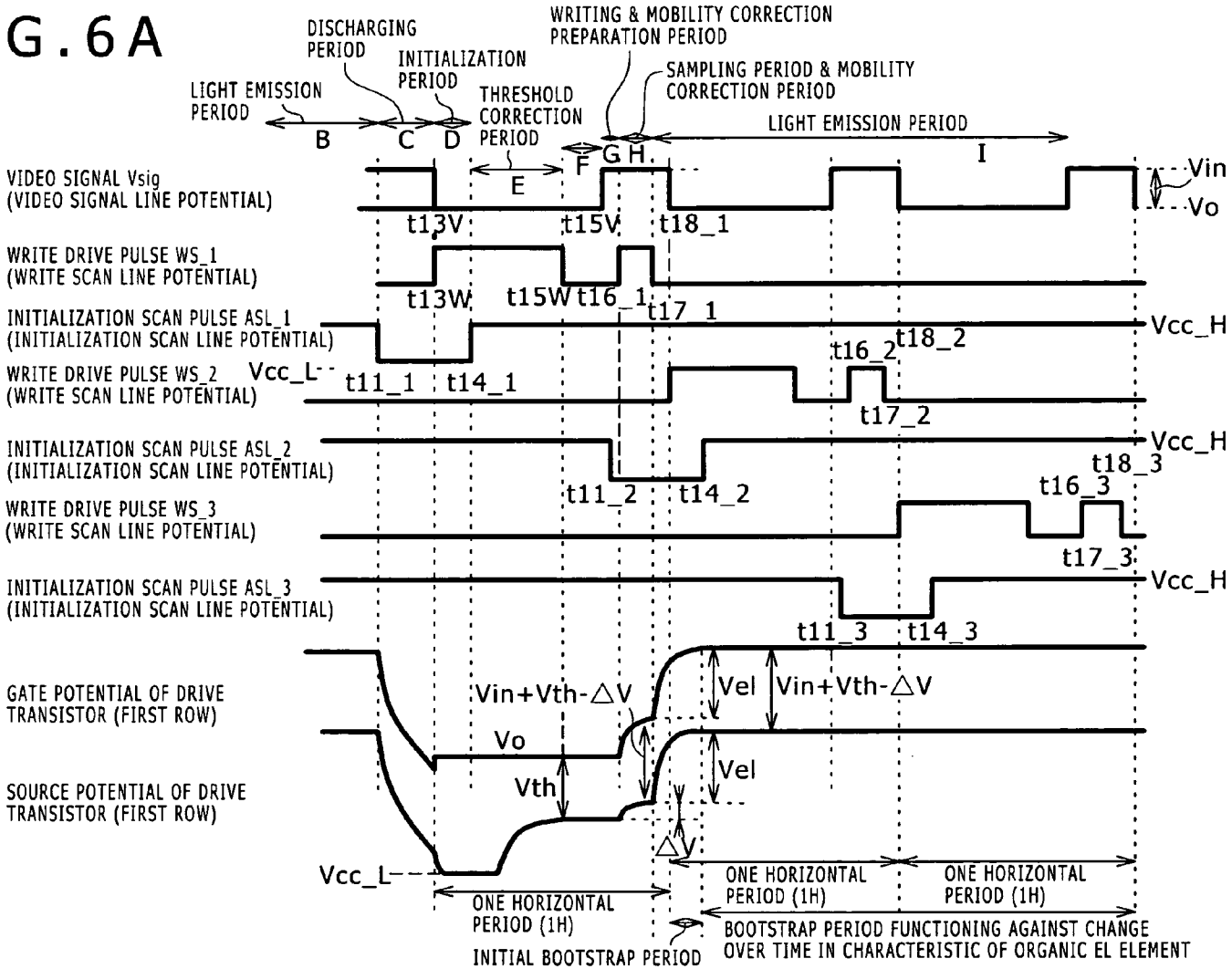
FIG. 6A is a timing chart for explaining a basic example of drive timings relating to the pixel circuit of the embodiment shown in FIG. 5.
Figure 6B:
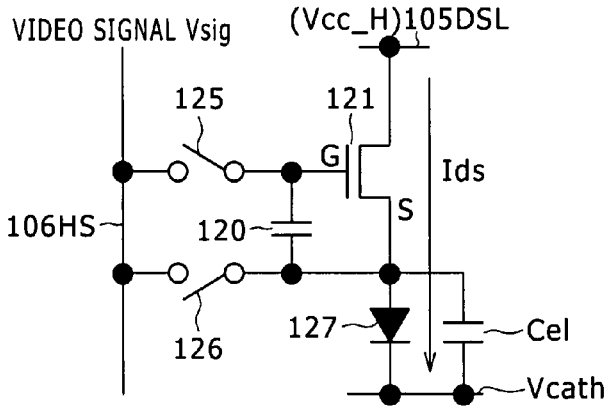
FIG. 6B is a diagram for explaining the equivalent circuit and the operation in a light emission period B based on the drive timings for the pixel circuit of the embodiment.

Therefore, as shown in FIG. 6B, irrespective of the potential of the video signal line 106HS, the drive current Ids is supplied from the drive transistor 121 to the organic EL element 127 and flows into the ground line Vcath (GND) common to all the pixels, depending on the state of the voltage held in the holding capacitor 120 (the gate-source voltage Vgs of the drive transistor 121) due to operation in the previous filed. Thus, the organic EL element 127 is in the light emission state.

Thereafter, a new field of the line-sequential scanning is started. Initially, the horizontal driver 106 sets the video signal Vsig to the initialization potential Vini in the state in which both the write drive pulse WS and the initialization scan pulse ASL are in the inactive-L state (t13V). Thereafter, the write scanner 104 switches the write drive pulse WS to the active-H state to thereby turn on the sampling transistor 125 (t13W), and the initialization scanner 115 switches the initialization scan pulse ASL to the active-H state to thereby turn on the initialization transistor 126 (t13A).

Figure 6C:
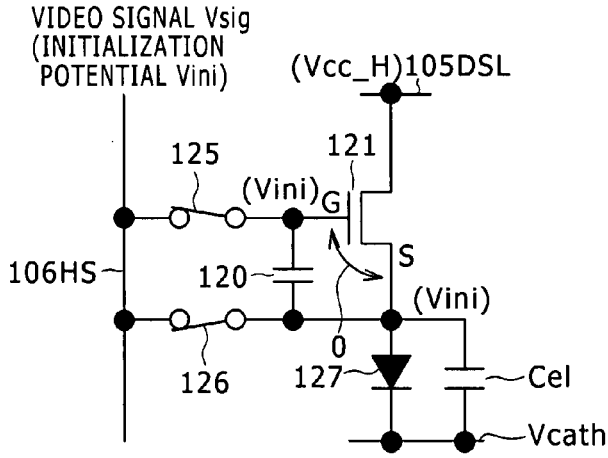
FIG. 6C is a diagram for explaining the equivalent circuit and the operation in an initialization period C based on the drive timings for the pixel circuit of the embodiment.

Thus, as shown in FIG. 6C, due to the turning-on of both the sampling transistor 125 and the initialization transistor 126, both the gate potential Vg and the source potential Vs of the drive transistor 121 are initialized to the initialization potential Vini supplied from the video signal line 106HS. Of course, the gate-source voltage Vgs of the drive transistor 121 becomes zero.

As is apparent also from this feature, the respective switch timings t13V, t13W, and t13A may be somewhat shifted from each other. This is because the initialization operation for the gate G and the source S of the drive transistor 121 is effective when the video signal Vsig is at the initialization potential Vini and both the sampling transistor 125 and the initialization transistor 126 are in the on-state. In FIG. 6, the respective switch timings t13V, t13W, and t13A are shown as substantially the same timing. The period during which the initialization operation is effective will be referred to as an initialization period C, for initializing the gate potential Vg and the source potential Vs of the drive transistor 121, or a threshold correction preparation period.

Subsequently, in the middle part of one horizontal period, with the write drive pulse WS kept active-H, the initialization scanner 115 switches the initialization scan pulse ASL supplied to the initialization scan line 115ASL from the active-H state to the inactive-L state, to thereby turn off the initialization transistor 126 (t14A). From then on, the initialization scanner 115 keeps the potential of the initialization scan line 115ASL at the inactive-L state until processing for the next frame (field).

Furthermore, almost simultaneously with this switching, the horizontal driver 106 switches the potential of the video signal Vsig from the initialization potential Vini to the reference potential Vo (t14V). At this time, because the sampling transistor 125 is in the on-state, the reference potential Vo is transmitted to the gate G of the drive transistor 121, which leads to the transition of the gate potential Vg thereof from the initialization potential Vini to the reference potential Vo. The switch timings t14A and t14V may be substantially the same, and therefore may be somewhat shifted from each other.

Due to this operation, a drain current flows into the holding capacitor 120, so that a threshold correction period E for correcting (cancelling) the threshold voltage Vth of the drive transistor 121 starts. This threshold correction period E continues until the timing at which the write drive pulse WS is switched to the inactive-L state (t15W).

Figure 6D:
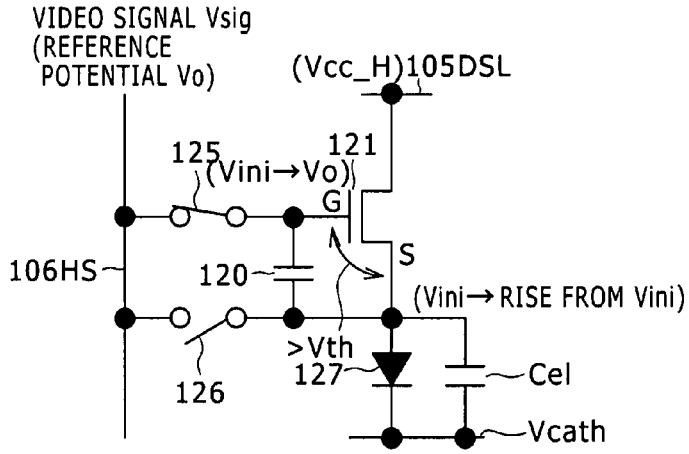
FIG. 6D is a diagram for explaining the equivalent circuit and the operation in a beginning period D of a threshold correction period E based on the drive timings for the pixel circuit of the embodiment.

As shown in FIG. 6D, as the initial operation when the threshold correction period E subsequent to the timings t14A and t14V starts, the gate potential Vg of the drive transistor 121 rises up from the initialization potential Vini to the reference potential Vo, and simultaneously, the source potential Vs starts to rise up from the initialization potential Vini. The ways of the rising-up of the gate potential Vg and the source potential Vs, which depend on the magnitude relationship between the capacitance Cs of the holding capacitor 120 and the parasitic capacitance Cel of the organic EL element 127, are so set that the gate potential Vg rises up faster than the source potential Vs. In this process (in particular, after the gate potential Vg has reached the reference potential Vo), the gate-source voltage Vgs is higher than the threshold voltage Vth of the drive transistor 121.

Figure 6E:
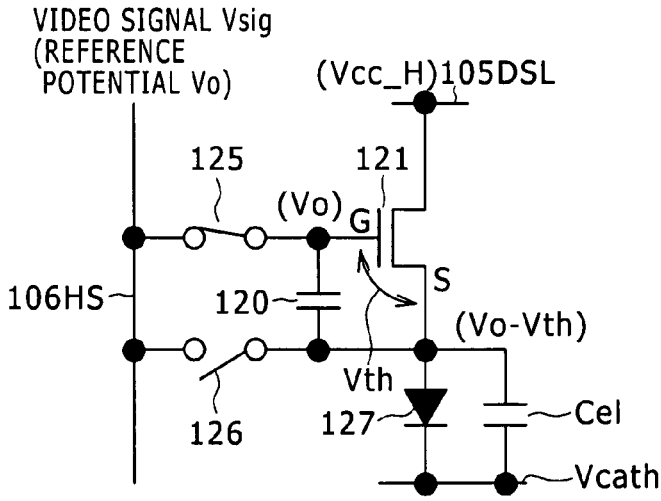
FIG. 6E is a diagram for explaining the equivalent circuit and the operation in the threshold correction period E based on the drive timings for the pixel circuit of the embodiment.

The gate G of the drive transistor 121 is kept at the reference potential Vo of the video signal Vsig. In time, as shown in FIG. 6E, the gate-source voltage Vgs becomes the threshold voltage Vth as the result of the rising-up of the source potential Vs of the drive transistor 121, so that the drive transistor 121 is cut off. Until this cut-off, the drain current flows. When the drive transistor 121 is cut off, the source potential Vs of the drive transistor 121 is "Vo-Vth".

In order for the drain current to flow exclusively toward the holding capacitor 120 (when Cs<<Cel) and be prevented from flowing to the organic EL element 127 in the threshold correction period E, the potential Vcath of the common ground line cath and the initialization potential Vini are so set that the organic EL element 127 is cut off in this period E.

The equivalent circuit of the organic EL element 127 is expressed as a parallel circuit formed of a diode and the parasitic capacitor Cel. Therefore, as long as the relationship "Vel≦Vcath+VthEL" is satisfied, i.e., as long as the leakage current from the organic EL element 127 is considerably smaller than the current flowing through the drive transistor 121, the current from the drive transistor 121 is used to charge the holding capacitor 120 and the parasitic capacitor Cel.

As a result, if the current path of the drain current flowing through the drive transistor 121 is blocked, the voltage Vel of the anode A of the organic EL element 127, i.e., the potential of the node ND121, rises up over time. When the potential difference between the potential of the node ND121 (source potential Vs) and the potential of the node ND122 (gate potential Vg) has just become equivalent to the threshold voltage Vth, the drive transistor 121 is switched from the on-state to the off-state and thus the flow of the drain current is stopped, which is equivalent to the end of the threshold correction period. That is, after the elapse of a certain time, the gate-source voltage Vgs of the drive transistor 121 becomes equivalent to the threshold voltage Vth.

In practice, the voltage equivalent to the threshold voltage Vth is written to the holding capacitor 120 connected between the gate G and the source S of the drive transistor 121. However, when the threshold correction period E, which is from the timing at which the initialization scan pulse ASL is switched to the inactive-L state (t14A) and the video signal Vsig is switched to the reference potential Vo (t14V) with the write drive pulse WS kept active-H to the timing at which the write drive pulse WS is returned to the inactive-L state (t15W), is not ensured sufficiently, this period E is ended before the writing of the voltage equivalent to the threshold voltage Vth. In order to solve this problem, it is preferable that the threshold correction operation be repeated plural times. In FIG. 6, indication of the timings of the repetition of the threshold correction operation is omitted.

Figure 6F:
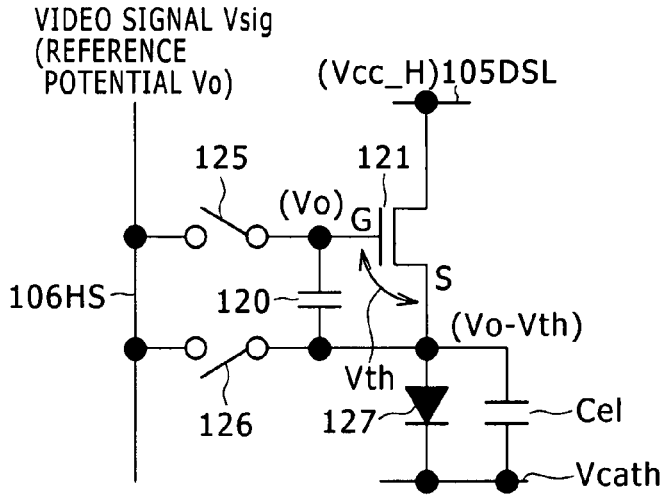
FIG. 6F is a diagram for explaining the equivalent circuit and the operation in a period F based on the drive timings for the pixel circuit of the embodiment.

In the latter part of one horizontal period, the write scanner 104 switches the write drive pulse WS to the inactive-L state (t15W), and then the horizontal driver 106 switches the potential of the video signal line 106HS from the reference potential Vo to the signal potential Vin (t15V). Thus, as shown in FIG. 6F, in the period from the timing t15W to the timing t15V, the potential of the write scan line 104WS (write drive pulse WS) is at the low level in the state in which the video signal line 106HS is at the reference potential Vo.

Thereafter, in a predetermined period, the signal potential Vin of the video signal Vsig is actually supplied to the video signal line 106HS by the horizontal driver 106, and the write drive pulse WS is kept active-H. This period will be referred to as a writing period (also as a sampling period), for writing the signal potential Vin to the holding capacitor 120. This signal potential Vin is held in such a manner as to be added to the threshold voltage Vth of the drive transistor 121.

As a result, variation in the threshold voltage Vth of the drive transistor 121 is always cancelled, and thus threshold correction is achieved. Due to this threshold correction, the gate-source voltage Vgs held in the holding capacitor 120 becomes "Vsig+Vth"="Vin+Vth". Furthermore, simultaneously, mobility correction is carried out in this sampling period. Specifically, according to the drive timings for the pixel circuit P of the present embodiment, the sampling period serves also as the mobility correction period.

Figure 6G:
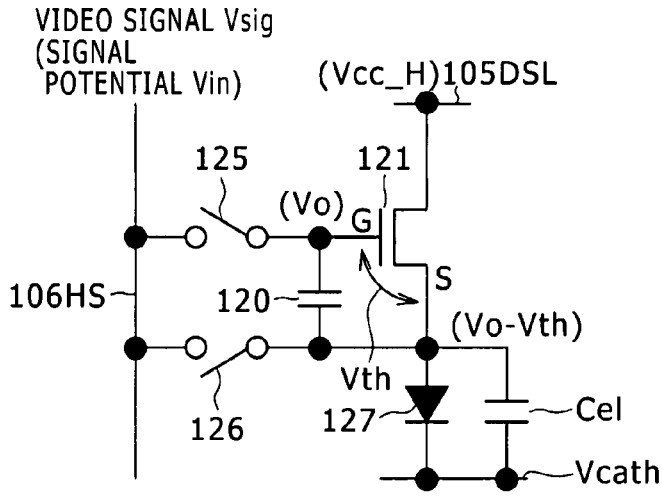
FIG. 6G is a diagram for explaining the equivalent circuit and the operation in a writing and mobility correction preparation period G based on the drive timings for the pixel circuit of the embodiment.

Specifically, initially the write scanner 104 switches the write drive pulse WS to the inactive-L state (t15W). Furthermore, the horizontal driver 106 switches the potential of the video signal line 106HS from the reference potential Vo to the signal potential Vin (t15V). Due to this operation, as shown in FIG. 6G, the preparation for the subsequent sampling operation and mobility correction operation is completed in the state in which the sampling transistor 125 is in the non-conductive (off) state. This period until the timing of the subsequent switching of the write drive pulse WS to the active-H state (t16_1) will be referred to as a writing and mobility correction preparation period G.

Subsequently to the period G, with the potential of the video signal line 106HS kept at the signal potential Vin, the write scanner 104 switches the write drive pulse WS to the active-H state (t16_1). Subsequently, the write scanner 104 switches the write drive pulse WS to the inactive-L state (t17_1) at a proper timing in the period until the horizontal driver 106 switches the potential of the video signal line 106HS from the signal potential Vin to the reference potential Vo (t18_1), i.e., at a proper timing in the time zone during which the video signal line 106HS is at the signal potential Vin. This period during which the write drive pulse WS is active-H (t16_1 to t17_1) will be referred to as a sampling period and mobility correction period H.

By carrying out the operation of correcting change and variation in the mobility of the drive transistor 121 simultaneously with the sampling of the signal potential Vin of the video signal Vsig in the holding capacitor 120, an advantage can be achieved that the total processing time can be shortened and control of the processing can be simplified compared with the case of carrying out the mobility correction and the sampling at different timings.

Figure 6H:
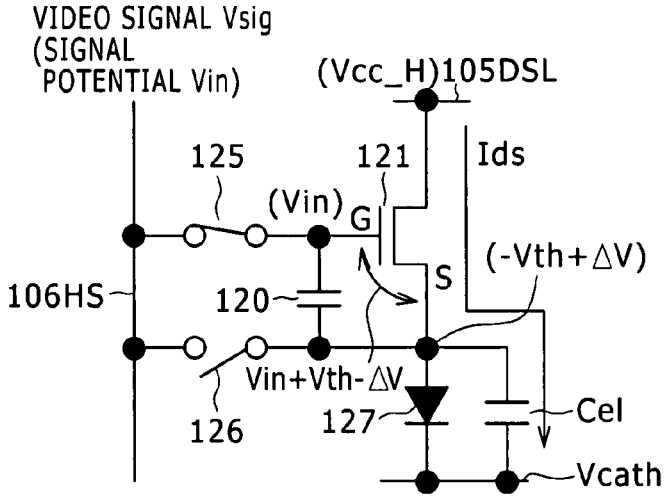
FIG. 6H is a diagram for explaining the equivalent circuit and the operation in a sampling period and mobility correction period H based on the drive timings for the pixel circuit of the embodiment.

Due to the switching at the timing t16_1, as shown in FIG. 6H, the gate potential Vg of the drive transistor 121 is at the signal potential Vin while the sampling transistor 125 is in the conductive (on) state. Therefore, in the sampling period and mobility correction period H, in the state in which the gate G of the drive transistor 121 is fixed at the signal potential Vin of the video signal Vsig, the drive transistor 121 is kept at the on-state and thus the drive current Ids flows through the drive transistor 121. At this time, the gate-source voltage Vgs of the drive transistor 121 becomes "Vin+Vth" initially.

If the relationship "Vo−Vth<VthEL" in which VthEL denotes the threshold voltage of the organic EL element 127 is set in advance, the organic EL element 127 is in the reverse-biased state and thus in the cut-off state (high-impedance state). Therefore, the organic EL element 127 does not emit light, and shows not a diode characteristic but a simple capacitor characteristic. Thus, the drain current (drive current Ids) flowing through the drive transistor 121 is written to the capacitor "C=Cs+Cel", arising from coupling between the capacitance Cs of the holding capacitor 120 and the capacitance Cel of the parasitic capacitor (equivalent capacitor) Cel of the organic EL element 127.

This causes the drive current Ids of the drive transistor 121 to flow to the parasitic capacitor Cel of the organic EL element 127 and start charging thereof. As a result, the potential of the anode A of the organic EL element 127, i.e., the source potential Vs of the drive transistor 121, starts to rise up. When the source potential Vs of the drive transistor 121 increases by ΔV, the gate-source voltage Vgs of the drive transistor 121 decreases by ΔV.

This is equivalent to the mobility correction operation. When the mobility correction period (the sampling period and mobility correction period H in FIG. 6) is "t", the decrease amount ΔV of the gate-source voltage Vgs is determined in accordance with the equation ΔV=Ids·Cel/t, and the amount ΔV serves as a parameter for the mobility correction (mobility correction parameter, negative feedback amount).

This potential rise is indicated by ΔV in the timing chart of FIG. 6. This potential rise, i.e., the negative feedback amount ΔV as the mobility correction parameter, is subtracted from the gate-source voltage "Vgs=Vin+Vth" held in the holding capacitor 120 due to the threshold correction. Thus, the gate-source voltage Vgs becomes "Vin−ΔV+Vin", which is equivalent to negative feedback to the gate-source voltage Vgs. At this time, the source potential Vs of the drive transistor 121 is "−Vth+ΔV", arising from subtraction of the voltage "Vgs=Vin−ΔV+Vth" held in the holding capacitor from the gate potential Vg (=Vin).

In this manner, according to the drive timings for the pixel circuit P of the present embodiment, the sampling of the signal potential Vin of the video signal Vsig and the adjustment of the negative feedback amount (mobility correction parameter) ΔV for correcting the mobility μ are carried out in the sampling period and mobility correction period H (t16 to t17). The write scanner 104 can regulate the time width of the sampling period and mobility correction period H, and thereby can optimize the negative feedback amount for the drive current Ids to the holding capacitor 120.

The expression "optimize the negative feedback amount" refers to setting for allowing proper mobility correction at any level in the range from the black level to the white level of the video signal potential. The negative feedback amount ΔV for the gate-source voltage Vgs depends on the extraction time of the drain current Ids, i.e., the sampling period and mobility correction period H. The longer this period is set, the larger the negative feedback amount becomes.

As is apparent from the aforementioned equation, a larger drive current Ids, which is the drain-source current of the drive transistor 121, provides a larger negative feedback amount ΔV. In contrast, a smaller drive current Ids of the drive transistor 121 provides a smaller negative feedback amount ΔV. In this manner, the negative feedback amount ΔV depends on the drive current Ids.

Furthermore, as described in detail later, a higher signal potential Vin provides a larger drive current Ids and thus a larger absolute value of the negative feedback amount ΔV. Therefore, the mobility correction dependent upon the light emission luminance level can be realized. In this mobility correction, the sampling period and mobility correction period H does not necessarily need to be constant. On the contrary, it is preferable that the period H be adjusted depending on the drive current Ids in some cases. For example, when the drive current Ids is large, the mobility correction period t is set short. In contrast, when the drive current Ids is small, the sampling period and mobility correction period H is set long.

Furthermore, the negative feedback amount ΔV is equal to Ids·Cel/t. Therefore, even when the drive current Ids varies attributed to variation in the mobility μ among the pixel circuits P, the negative feedback amounts ΔV each corresponding to a respective one of the drive currents Ids can be obtained, which can correct the variation in the mobility μ among the pixel circuits P. That is, when the signal potential Vin is constant, a higher mobility μ of the drive transistor 121 provides a larger absolute value of the negative feedback amount ΔV. In other words, because a higher mobility μ provides a larger negative feedback amount μV, the variation in the mobility μ among the pixel circuits P can be eliminated.

As described above, according to the drive timings for the pixel circuit P of the present embodiment, the sampling of the signal potential Vin and the adjustment of the negative feedback amount ΔV for correcting variation in the mobility μ are simultaneously carried out in the sampling period and mobility correction period H. Of course, the negative feedback amount ΔV indicating the correction amount for mobility variation can be optimized by adjusting the pulse width of the write drive pulse WS as the sampling signal for the signal potential Vin, i.e., the time width of the sampling period and mobility correction period H.

Subsequently to the period H, the write scanner 104 switches the write drive pulse WS to the inactive-L state (t17_1) in the state in which the potential of the video signal line 106HS is the signal potential Vin. Thereafter, in the period (light emission period I) during which the drive current Ids based on the information held in the holding capacitor 120 flows through the organic EL element 127, the write drive pulse WS is continuously kept inactive-L to thereby keep the sampling transistor 125 at the non-conductive state.

Figure 6I:
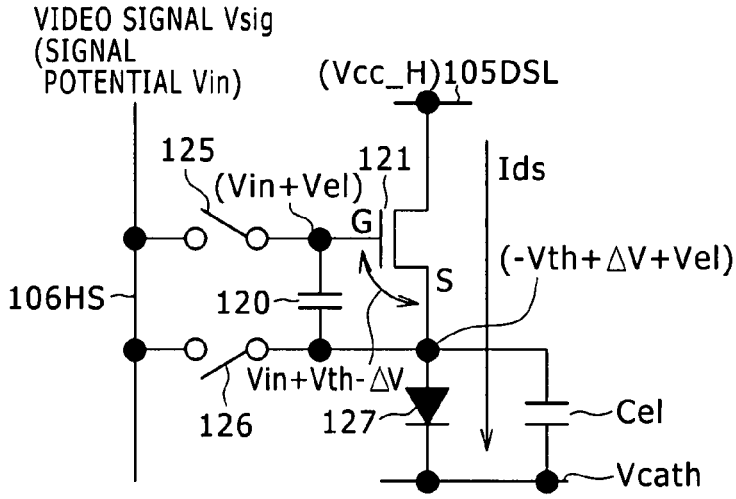
FIG. 6I is a diagram for explaining the equivalent circuit and the operation in a light emission period I based on the drive timings for the pixel circuit of the embodiment.

Thus, as shown in FIG. 6I, the light emission period I starts in response to the switching of the sampling transistor 125 to the non-conductive (off) state. At a certain timing after the start of the light emission period I, the horizontal driver 106 stops the supply of the signal potential Vin of the video signal Vsig to the video signal line 106HS, and returns the potential of the video signal Vsig to the reference potential Vo (t18_1). Thereafter, the next frame (field) starts, so that the threshold correction preparation operation, threshold correction operation, mobility correction operation, and light emission operation are repeated again.

As a result of the turning-off of the sampling transistor 125, the gate G of the drive transistor 121 is isolated from the video signal line 106HS. Thus, the application of the signal potential Vin to the gate G of the drive transistor 121 is stopped, which allows rising-up of the gate potential Vg of the drive transistor 121.

At this time, the drive current Ids flowing through the drive transistor 121 flows to the organic EL element 127, so that the anode potential of the organic EL element 127 rises up depending on the drive current Ids. This potential rise amount will be defined as Vel. In time, in step with the rise of the source potential Vs, the reverse-biased state of the organic EL element 127 is eliminated. Therefore, the organic EL element 127 starts light emission actually due to the flowing of the drive current Ids thereto. The anode potential rise (Vel) of the organic EL element 127 at this time is equivalent to the rise of the source potential Vs of the drive transistor 121. Thus, the source potential Vs of the drive transistor 121 becomes "−Vth+ΔV+Vel".

The relationship between the drive current Ids and the gate voltage Vgs can be expressed by Equation (2), which is obtained by substituting "Vin−ΔV+Vth" for Vgs in Equation (1) for representing a transistor characteristic. In Equation (2), k=(½) (W/L)Cox.

$$Ids=k\mu(Vgs-Vth)^2=k\mu(Vin-\Delta V)^2 \quad (2)$$

As is apparent from Equation (2), the threshold voltage Vth is cancelled from Equation (1), and hence the drive current Ids supplied to the organic EL element 127 does not depend on the threshold voltage Vth of the drive transistor 121. Basically, the drive current Ids is determined by the signal potential Vin of the video signal Vsig. In other words, the organic EL element 127 emits light with the luminance dependent upon the signal potential Vin.

For the light emission, the signal potential Vin is corrected by the feedback amount ΔV. This correction amount ΔV functions to cancel the effect of the mobility μ, which is at the coefficient part in Equation (2). Consequently, the drive current Ids depends only on the signal potential Vin substantially. The drive current Ids is independent of the threshold voltage Vth. Thus, even when the threshold voltage Vth varies due to manufacturing process variation, the drive current Ids between the drain and source does not vary, and therefore the light emission luminance of the organic EL element 127 also does not vary.

Furthermore, the holding capacitor 120 is connected between the gate G and the source S of the drive transistor 121. Due to the effect of the holding capacitor 120, bootstrap operation is carried out at the beginning of a light emission period, so that the gate potential Vg and the source potential Vs of the drive transistor 121 rise up in such a way that the gate-source voltage "Vgs=Vin−ΔV+Vth" of the drive transistor 121 is kept constant. The source potential Vs of the drive transistor 121 becomes "−Vth+ΔV+Vel", and thus the gate potential Vg becomes "Vin+Vel".

At this time, the drive transistor 121 supplies a constant current (drive current Ids) to the organic EL element 127, because the gate-source voltage Vgs of the drive transistor 121 is constant. As a result, a voltage drop arises, so that the potential Vel of the anode A of the organic EL element 127 (=the potential of the node ND121) rises up to the voltage that allows the drive current Ids in the saturation state to flow through the organic EL element 127.

That is, according to the drive timings in the present embodiment, the bootstrap function can be started at the timing of light emission start, at which the write drive pulse WS is switched to the inactive-L state and thus the sampling transistor 125 is turned off. In the subsequent initial stage of the light emission, the bootstrap operation functions during the change of the source potential Vs of the drive transistor 121 in linkage with the change of the anode-cathode voltage Vel, in the process of the rising-up of the anode-cathode voltage Vel to a stable voltage in response to the start of the flowing of a light emission current Iel through the organic EL element 127.

When the potential of the anode A of the organic EL element 127 rises up by Vel, the source potential Vs of the drive transistor 121 also rises up by Vel, of course. At this time, due to the bootstrap operation by the holding capacitor 120 between the gate and source, the gate potential Vg of the drive transistor 121 also rises up by Vel. Thus, the gate-source voltage "Vin+Vth−ΔV" of the drive transistor 121, held before the bootstrap, is kept also after the bootstrap operation in the initial stage of the light emission.

The I-V characteristic of the organic EL element 127 changes as the total light emission time thereof becomes longer. Therefore, the anode potential of the organic EL element 127 (i.e., the potential of the node ND121) also changes over time. However, even when the anode potential of the organic EL element 127 varies attributed to the change over time (referred to also as deterioration over time) in the organic EL element 127, the gate-source voltage Vgs held in the holding capacitor 120 is always kept constant at "Vin−ΔV+Vth" due to the bootstrap operation by the holding capacitor 120 between the gate and source.

The drive transistor 121 operates as a constant current source. Therefore, even when the I-V characteristic of the organic EL element 127 changes over time and correspondingly the source potential Vs of the drive transistor 121 changes, the gate-source voltage Vgs of the drive transistor 121 is kept constant (≈Vin−ΔV+Vth) by the holding capacitor 120. Thus, the current flowing through the organic EL element 127 is invariant, and hence the light emission luminance of the organic EL element 127 is also kept constant.

This operation (operation due to the effect of the holding capacitor 120) for correction, by which the gate-source voltage of the drive transistor 121 is kept constant and thus the luminance is kept constant irrespective of change in a characteristic of the organic EL element 127, is referred to as the bootstrap operation. Due to this bootstrap operation, even when the I-V characteristic of the organic EL element 127 changes over time, image displaying without luminance deterioration accompanying the change over time is permitted.

That is, according to the pixel circuit P of the present embodiment and the drive timings thereof, a bootstrap circuit is constructed as one example of drive-signal constantly-keeping circuits for maintaining the drive current constant by correcting change in the current-voltage characteristic of the organic EL element 127 as one example of electro-optical elements, so that the functioning of the bootstrap operation is allowed. Therefore, even when the I-V characteristic of the organic EL element 127 deteriorates, the flow of the constant current Ids always continues. Thus, the organic EL element 127 continues light emission with the luminance dependent upon the pixel signal Vsig, and hence the luminance does not vary. The bootstrap operation makes it possible to correct variation in the drive current Ids (and the light emission current Iel) accompanying change over time in the organic EL element 127 (or another current-driven light-emitting element).

Furthermore, according to the pixel circuit P of the present embodiment and the drive timings thereof, a threshold correction circuit is constructed as one example of drive-signal constantly-keeping circuits for maintaining the drive current constant by correcting the threshold voltage Vth of the drive transistor 121, so that the functioning of the threshold correction operation is allowed. The threshold correction operation allows the threshold voltage Vth of the drive transistor 121 to be reflected in the gate-source voltage Vgs, and thus can supply the constant current Ids that is never affected by variation in the threshold voltage Vth.

In particular, the threshold voltage Vth can be surely held in the holding capacitor 120 by repeating the threshold correction operation plural times with the processing cycle thereof set to one horizontal period, although not shown in the drawing. This surely eliminates the differences in the threshold voltage Vth among the pixels, and thus can suppress luminance unevenness attributed to the variation in the threshold voltage Vth irrespective of the grayscale.

In contrast, when the correction of the threshold voltage Vth is insufficient because the number of times of the threshold correction operation is only one for example, i.e., when the threshold voltage Vth is not held in the holding capacitor 120, differences in the luminance (drive current Ids) among the different pixel circuits P will occur in the low grayscale region. Therefore, when the correction of the threshold voltage is insufficient, unevenness of the luminance appears at low grayscales and hence the image quality is deteriorated.

According to the pixel circuit P of the present embodiment and the drive timings thereof, a mobility correction circuit is constructed as one example of drive-signal constantly-keeping circuits for maintaining the drive current constant by correcting the mobility μ of the drive transistor 121 in linkage with the operation of writing the signal potential Vin to the holding capacitor 120 by the sampling transistor 125, so that the functioning of the mobility correction operation is allowed. The mobility correction operation allows the carrier mobility μ of the drive transistor 121 to be reflected in the gate-source voltage Vgs, and thus can supply the constant current Ids that is never affected by variation in the carrier mobility μ.

That is, in the pixel circuit P of the present embodiment, the threshold correction circuit and the mobility correction circuit are automatically constructed through inventive designing of the drive timings. Furthermore, in order to prevent the influence on the drive current Ids due to variations in characteristics of the drive transistor 121 (variations in the threshold voltage Vth and the carrier mobility μ, in the present example), these circuits each function as a drive-signal constantly-keeping circuit for maintaining the drive current constant by correcting the influence due to the threshold voltage Vth and the carrier mobility μ.

Because not only the bootstrap operation but also the threshold correction operation and the mobility correction operation are carried out, the gate-source voltage Vgs maintained by the bootstrap operation results from adjustment with the voltage equivalent to the threshold voltage Vth and the voltage ΔV for the mobility correction. Thus, the light emission luminance of the organic EL element 127 is never affected by variations in the threshold voltage Vth and the mobility μ of the drive transistor 121, and never affected by the deterioration of the organic EL element 127 over time, too. Displaying with stable grayscales corresponding to the input signal potentials Vin is allowed, and thus high-quality images can be obtained.

Furthermore, the pixel circuit P of the present embodiment can be formed with a source follower circuit employing the n-channel drive transistor 121, and thus can drive the organic EL element 127 even when an organic EL element having present anode and cathode electrodes is used as it is.

Moreover, the pixel circuit P can be formed by using only n-channel transistors, including even the sampling transistor 125 as well as the drive transistor 121. Therefore, an amorphous silicon (a-Si) process can be used in TFT fabrication, which allows reduction in the cost of the TFT substrate.

<Relationship Between Bootstrap Operation and Parasitic Capacitance>

Figure 7:
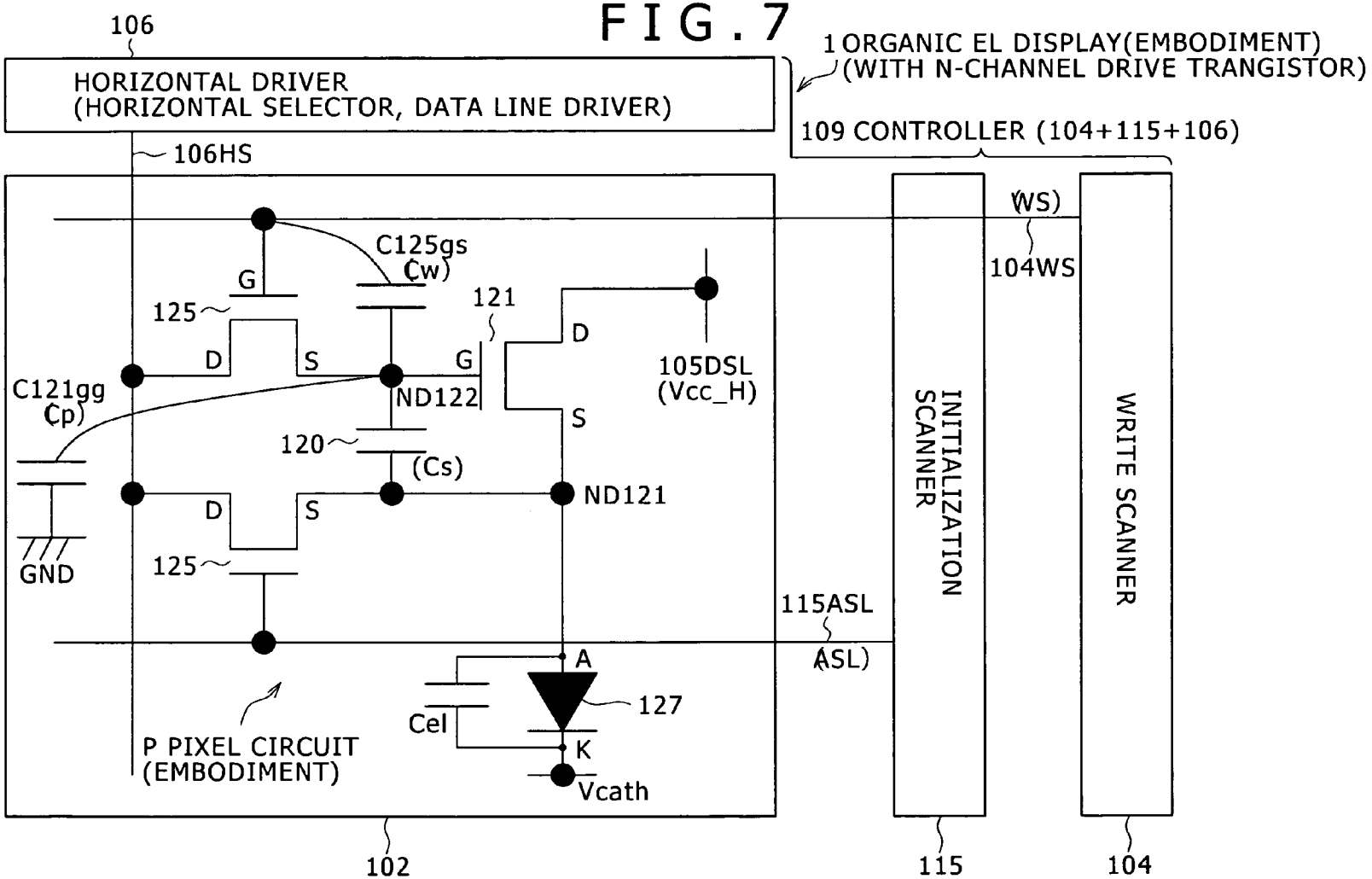
FIG. 7 is a diagram for explaining the relationship between bootstrap operation and a parasitic capacitor arising at the gate of a drive transistor.

FIG. 7 is a diagram for explaining the relationship between bootstrap operation and a parasitic capacitor arising at the gate G of the drive transistor 121. As the parasitic capacitor arising at the gate G of the drive transistor 121 in the configuration of FIG. 7, as one example, a parasitic capacitor C125*gs* (having a capacitance of Cw) formed between the gate G and the source S (drain D, when the source S is connected to the video signal line 106HS) of the sampling transistor 125 exists. Furthermore, a parasitic capacitor C121*gg* (having a capacitance of Cp) formed between the gate G of the drive transistor 121 and the ground (GND) also exists.

Also between the gate G and the source S of the drive transistor 121, a parasitic capacitor (C121*gs*) is formed. However, this parasitic capacitor (C121*gs*) is in parallel to the holding capacitor 120 connected between the gate G and the source S of the drive transistor 121 and can offer the same effects as those by the holding capacitor 120. Therefore, the parasitic capacitor (C121$gs$) may be ignored in the description of the relationship between bootstrap operation and the parasitic capacitor.

In addition, also between the gate G and the drain D of the drive transistor 121, a parasitic capacitor (C121$gd$) is formed. However, because this parasitic capacitor (C121$gd$) is in parallel to the parasitic capacitor C125$gs$, the parasitic capacitor (C121$gd$) may be ignored by considering the capacitance of this parasitic capacitor (C121$gd$) as being included in the capacitance Cw.

The ability of the above-described bootstrap operation (referred to as a bootstrap gain Gb) is expressed by the equation "Gb=Cs/(Cs+Cw+Cp)", in terms of the relationship among the capacitance Cs of the holding capacitor 120, the capacitance Cw of the parasitic capacitor C125$gs$, and the capacitance Cp of the parasitic capacitor C121$gg$. The bootstrap gain Gb closer to one means a higher gain Gb. That is, the gain Gb closer to one means that the ability for correcting the drive current Ids against change over time in the current-voltage characteristic of the organic EL element 127 is higher.

In the pixel circuit P of the present embodiment shown in FIG. 5, the number of elements connected to the gate G of the drive transistor 121 other than the holding capacitor 120 is minimized (specifically, only the sampling transistor 125). Therefore, the capacitance Cp of the parasitic capacitor C121$gg$ formed between the gate G and the ground (GND) can be almost ignored. Consequently, the bootstrap operation ability is expressed by the equation "Gb=Cs/(Cs+Cw)". Thus, if the capacitance Cw of the parasitic capacitor C125$gs$ is sufficiently lower than the capacitance Cs of the holding capacitor 120, the bootstrap gain Gb is extremely close to "one", which indicates that the ability for correcting the drive current Ids against change over time in the current-voltage characteristic of the organic EL element 127 is high.

That is, for the development of a scheme for realizing, with a simplified pixel circuit, threshold correction operation and mobility correction operation to suppress luminance variation due to variations in element characteristics, the pixel circuit P is provided in which only the sampling transistor 125 is employed as the element connected to the gate G of the drive transistor 121 other than the holding capacitor 120. Thus, the capacitance of the parasitic capacitor arising at the gate G of the drive transistor 121 can be set extremely low, which assists bootstrap operation and thus makes it possible to enhance the ability for correcting the drive current Ids against change over time in the current-voltage characteristic of the organic EL element 127.

Furthermore, for initialization operation for the drive transistor 121 previous to threshold correction, the initialization potential Vini is supplied previously to the reference potential Vo used for precharging by using the video signal line 106HS for the video signal Vsig as the interconnect for supplying the initialization potential. For this operation, the initialization transistor 126 that is turned on in the period of the initialization potential Vini is added to the basic 2TR-drive configuration, so that a 3TR-drive configuration is constructed. This configuration has smaller numbers of interconnects and transistors for correction, and smaller numbers of switching pulses for driving the transistors and interconnects for the switching pulses, compared with the 5TR-drive configuration described in Patent Document 1. Thus, a simplified pixel circuit can be achieved.

In a display including current-driven light-emitting elements typified by organic EL elements, all of correction for variation in the threshold of the drive transistor, correction for variation in the mobility of the drive transistor, and correction for change in the light-emitting element over time can be carried out with a smaller number of elements compared with the 5TR-drive configuration. This feature is suitable for definition enhancement and makes it easy to apply the current-driven light-emitting elements to a display used in a small electronic apparatus such as a portable apparatus (mobile apparatus).

This is the end of the description of the embodiment of the present invention. The technical scope of the present invention is not limited to the scope of the embodiment. Various modifications and improvements may be added to the embodiment without departing from the gist of the invention, and a mode obtained through the addition of the modifications and improvements is also encompassed by the technical scope of the present invention.

Furthermore, the embodiment will not limit the invention according to the claims, and all of combinations of the features in the embodiment are not necessarily essential for the solution measures in the invention. Inventions at various stages are encompassed in the embodiment, and various inventions can be extracted based on proper combinations of the disclosed plural constituent features. Even if several constituent features are removed from all the constituent features in the embodiment, the configuration resulting from the removal of these several constituent features can be extracted as an invention as long as an advantageous effect can be achieved.

<Modification Example of Pixel Circuit>

For example, in terms of the circuit theory, the "duality theory" is applicable to the pixel circuit P, and therefore a modification from this standpoint can be added to the pixel circuit P. As the modification, although illustration is omitted, the pixel circuit P is formed by using p-channel transistors in contrast to the pixel circuit P shown in FIG. 5, which employs n-channel transistors. For matching with this modification, changes in accordance with the duality theory are added, such as the reversal of the polarities of the initialization potential Vini and the signal potential Vin with respect to the reference potential Vo of the video signal Vsig and the reversal of the magnitude relationship among supply voltages.

For example, in the pixel circuit P of a modified mode in accordance with the "duality theory", the holding capacitor 120 is connected between the gate G and the source S of a p-channel drive transistor (hereinafter, referred to as a p-type drive transistor 121$p$). The source S of the p-type drive transistor 121$p$ is connected directly to the cathode K of the organic EL element 127. The anode A of the organic EL element 127 is supplied with an anode potential Vanode as a reference potential. This anode potential Vanode is connected to a reference power supply (higher potential side) that supplies the reference potential and is common to all the pixels. The drain D of the p-type drive transistor 121$p$ is connected to a supply potential Vcc_L on the lower voltage side, and allows the passage of the drive current Ids for causing the organic EL element 127 to emit light.

A p-channel sampling transistor (hereinafter, referred to as a p-type sampling transistor 125$p$) is disposed at the intersection between the video signal line 106HS and the write scan line 104WS. The gate G of the p-type sampling transistor 125$p$ is connected to the write scan line 104WS from the write scanner 104. The drain D (or the source S) thereof is connected to the video signal line 106HS, and the source S (or the drain D) thereof is coupled to the connecting node between the gate G of the p-type drive transistor 121$p$ and one terminal of the holding capacitor 120. To the gate G of the p-type sampling transistor 125$p$, the active-L write drive pulse WS is supplied from the write scanner 104.

A p-channel initialization transistor (hereinafter, referred to as a p-type initialization transistor 126*p*) is disposed at the intersection between the video signal line 106HS and the initialization scan line 115ASL. The gate G of the p-type initialization transistor 126*p* is connected to the initialization scan line 115ASL from the initialization scanner 115. The drain D (or the source S) thereof is connected to the video signal line 106HS, and the source S (or the drain D) thereof is coupled to the connecting node between the source S of the p-type drive transistor 121*p* and the other terminal of the holding capacitor 121. To the gate G of the initialization transistor 126, the active-L initialization scan pulse ASL is supplied from the initialization scanner 115.

Also in such a modification-example organic EL display in which p-type transistors are employed based on the duality theory, threshold correction preparation operation (initialization operation for the p-type drive transistor 121*p*) by the operation of the p-type initialization transistor 126*p*, threshold correction operation, mobility correction operation, and bootstrap operation can be carried out similarly to the above-described basic-example organic EL display including n-type transistors.

Although the above-described modification example is obtained by adding changes in accordance with the "duality theory" to the configuration shown in FIG. 5, the scheme for modifying the circuit is not limited thereto. The concept of the embodiment can be applied to any configuration as long as the configuration realizes the following features. Specifically, for execution of threshold correction operation, the video signal Vsig of which potential is switched among the initialization potential Vini, the reference potential Vo, and the signal potential Vin in each horizontal period in matching with the line-sequential scanning by the write scanner 104 is transmitted to the video signal line 106HS. Furthermore, the drive transistor 121 can be initialized by turning on the initialization transistor 126 in the period of the initialization potential Vini preceding the reference potential Vo.

<Modification Example of Drive Timings>

From the aspect of drive timings, various modifications are possible in which the timing of the transition of the potential of the power supply line 105DSL from the second potential Vcc_L to the first potential Vcc_H is set in the period of the reference potential Vo corresponding to the invalid period of the video signal Vsig.

As a modification example, although illustration is omitted (see FIGS. 8(B) and 11 to be described later), the scheme for setting the sampling period and mobility correction period H can be modified for the drive timings shown in FIG. 6. Specifically, first, the timing t15V at which the potential of the video signal Vsig is switched from the reference potential Vo to the signal potential Vin is shifted closer to the end of one horizontal period than the drive timing shown in FIG. 6, so that the period of the signal potential Vin as the valid period is shortened.

Furthermore, after the completion of threshold correction operation (after the completion of the threshold correction period E), the signal potential Vin of the video signal Vsig is supplied to the video signal line 106HS by the horizontal driver 106 (t16) in the state in which the write drive pulse WS is kept active-H. The period from the timing t16 to the timing at which the write drive pulse WS is switched to the inactive-L state (t17) is defined as the period for writing the pixel signal Vsig to the holding capacitor 120. This signal potential Vin is held in such a manner as to be added to the threshold voltage Vth of the drive transistor 121. As a result, variation in the threshold voltage Vth of the drive transistor 121 is always cancelled, and thus threshold correction is achieved. Due to this threshold correction operation, the gate-source voltage Vgs held in the holding capacitor 120 becomes "Vsig+Vth". Furthermore, simultaneously, mobility correction is carried out in the signal writing period from the timing t16 to the timing t17. That is, the period from t16 to t17 serves as both the signal writing period and the mobility correction period.

In this period from t16 to t17, in which the mobility correction is executed, the organic EL element 127 is in the reverse-biased state and hence does not emit light practically. In this mobility correction period from t16 to t17, the drive current Ids flows through the drive transistor 121 in the state in which the gate G of the drive transistor 121 is fixed at the level of the video signal Vsig. The subsequent drive timings are the same as those shown in FIG. 6.

The drive timings of the modification example are completely the same as those shown in FIG. 6 regarding the operation of initializing the drive transistor 121 by turning on the initialization transistor 126 in the period of the initialization potential Vini preceding the reference potential Vo. Thus, the modification example can offer the same advantages as those by the above-described embodiment, except for features relating to the modification of the sampling period and mobility correction period H.

According to the drive timings of the modification example, the respective drivers (104, 106) can optimize the mobility correction period by adjusting the relative phase difference between the video signal Vsig supplied from the horizontal driver 106 to the video signal line 106HS and the write drive pulse WS supplied from the write scanner 104.

However, the writing and mobility correction preparation period G is absent, and the period from the timing t16V to the timing t17W serves as the sampling period and mobility correction period H. This yields a possibility that the sampling period and mobility correction period H is affected by a difference in the waveform characteristic attributed to the influence of the dependency of the interconnect resistance and the interconnect capacitance of the write scan line 104WS and the video signal line 106HS upon the distance. Due to the dependency upon the distance, the sampling potential and the mobility correction period will differ between screen areas closer to and remoter from the write scanner 104 (i.e., the left and right sides on the screen). Accordingly, there is a fear of the occurrence of a problem that a luminance difference arises between the left and right sides on the screen and is visually recognized as shading.

A detailed description regarding the writing and mobility correction preparation period will be made below in view of the difference between the drive timings of the basic example shown in FIG. 6 and those of the modification example.

<Scheme for Setting Mobility Correction Period>

Figure 8A:
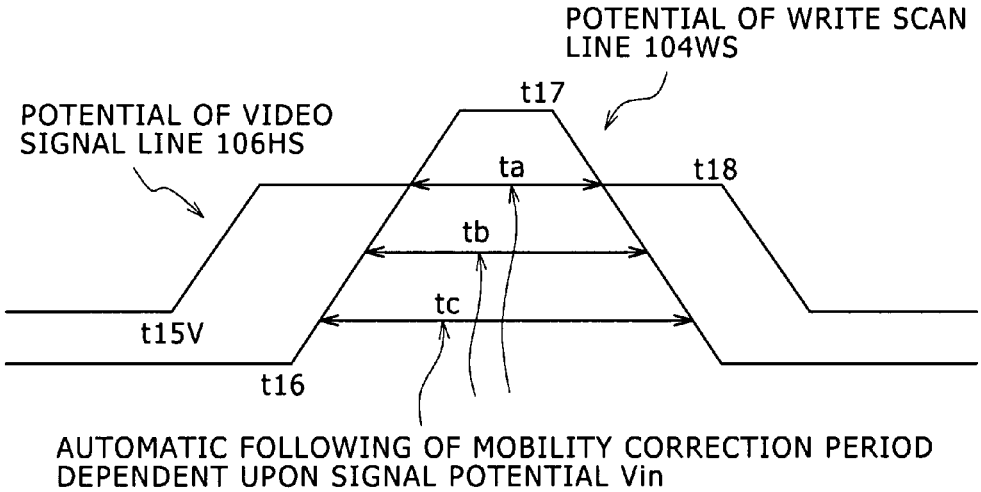
FIGS. 8A and 8B are schematic diagrams for explaining operation timings for determining a mobility correction period for a pixel circuit.
Figure 8B:
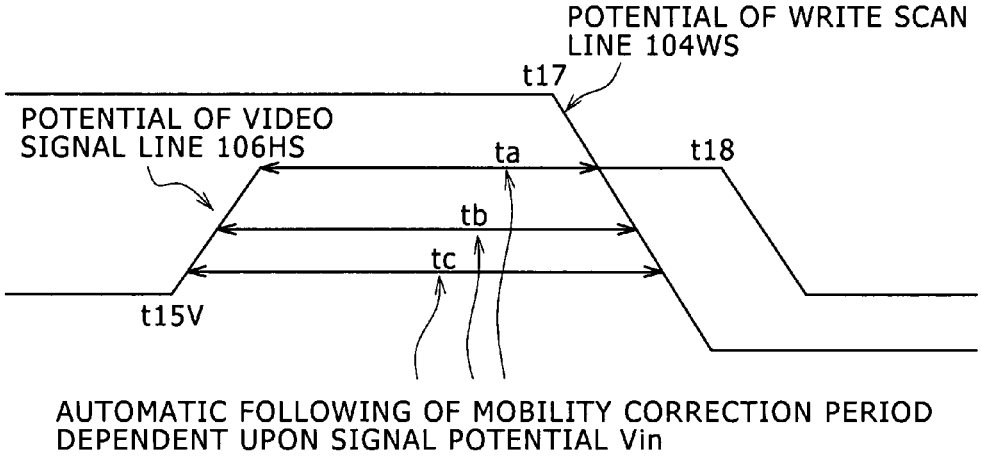

FIG. 8 is a schematic diagram for explaining the operation timings for determining the mobility correction period t for the pixel circuit P. FIG. 8A shows an example corresponding to the drive timings of the basic example shown in FIG. 6. FIG. 8B shows an example corresponding to the drive timings of the above-described modification example.

In either of the examples of FIGS. 8(A) and 8(B), the rising edge of the signal potential Vin of the video signal line 106HS (hereinafter, referred to also as a video signal line potential) is provided with a slope, which allows the mobility correction period t to automatically follow the video signal line potential to thereby optimize the mobility correction period t.

In the basic example shown in FIG. 8A, the mobility correction period t is determined by the pulse width of the write scan line 104WS, and further by the potential of the video signal line 106HS. The mobility correction parameter ΔV is expressed by the equation "ΔV=Ids·Cel/t". This equation can be converted to "t=Cel·ΔV/Ids".

As is apparent from these equations, according to the drive timings of the basic example, when the drain-source current (drive current Ids) of the drive transistor 121 is larger, the mobility correction parameter ΔV is larger and the mobility correction period t is shorter. In contrast, when the drive current Ids of the drive transistor 121 is smaller, the mobility correction parameter ΔV is smaller and the mobility correction period t is longer. Furthermore, the correction operation for change and variation in the mobility of the drive transistor 121 can be adjusted based on the pulse width of the write drive pulse WS for video signal sampling.

On the other hand, according to the drive timings of the modification example shown in FIG. 8B, the mobility correction period t is determined by the phase difference between the potential of the write scan line 104WS and the potential of the video signal line 106HS, and further by the potential itself of the video signal line 106HS. The mobility correction parameter ΔV is expressed by the equation "ΔV=Ids·Cel/t". This equation can be converted to "t=Cel·ΔV/Ids".

As is apparent from these equations, according also to the drive timings of the modification example, when the drain-source current (drive current Ids) of the drive transistor 121 is larger, the mobility correction parameter ΔV is larger and the mobility correction period t is shorter. In contrast, when the drive current Ids of the drive transistor 121 is smaller, the mobility correction parameter ΔV is smaller and the mobility correction period t is longer. As a difference from the drive timings of the basic example, the correction operation for change and variation in the mobility of the drive transistor 121 can be adjusted based on the phase difference between the potential of the write scan line 104WS and the potential of the video signal line 106HS.

As described above, although the scheme for setting the mobility correction period is somewhat different, the mobility correction parameter ΔV is determined depending on the drive current Ids (and the light emission current Iel) of the drive transistor 121 in either of the examples of FIGS. 8(A) and 8(B). In the mobility correction, the mobility correction period t does not necessarily need to be constant. On the contrary, it is preferable that the period t be adjusted depending on the drive current Ids in some cases. For example, the following setting is preferable in some cases. Specifically, when the drive current Ids is large, the mobility correction period t is set short. In contrast, when the drive current Ids is small, the mobility correction period t is set long.

In either of the examples of FIGS. 8(A) and 8(B), by providing a slope for at least the rising edge of the video signal line potential, the mobility correction period t can be adjusted depending on the potential of the video signal line 106HS. For example, when the potential of the video signal line 106HS is high, the drive current Ids is large and the mobility correction period t is short. In contrast, when the potential of the video signal line 106HS is low, the drive current Ids is small and the mobility correction period t is long (different mobility correction periods ta, tb, and tc are obtained depending on the potential of the video signal line 106HS). That is, the mobility correction period t can be set in such a manner as to automatically follow the video signal Vsig (specifically, the signal potential Vin).

<Relationship Between Mobility Correction Period and Interconnect Resistance and Interconnect Capacitance>

Figure 9A:
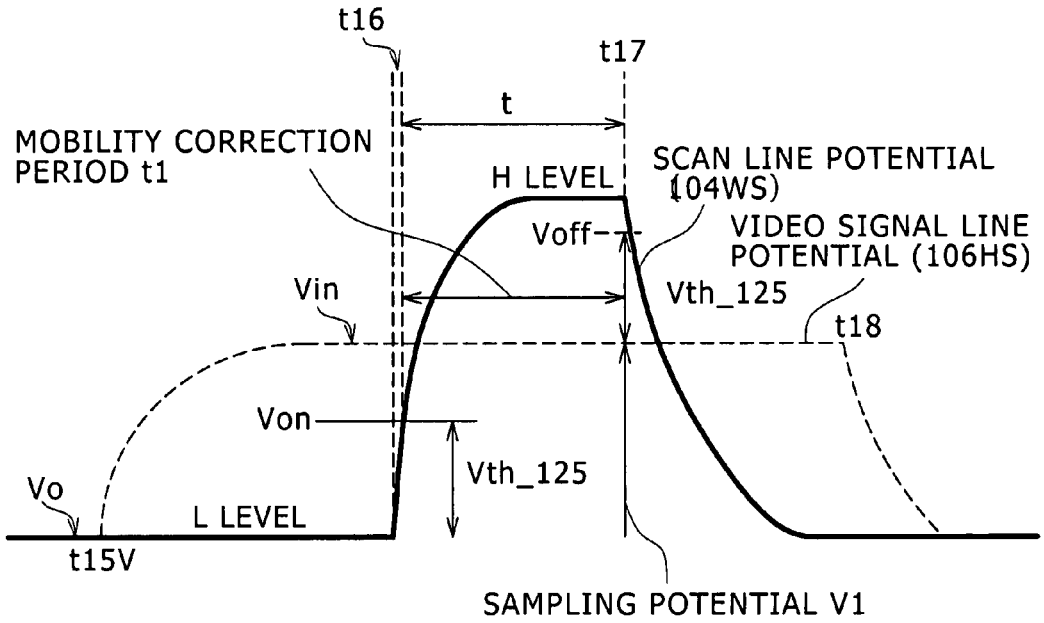
FIGS. 9A and 9B are schematic diagrams for explaining the relationship between a sampling period and mobility correction period and the interconnect resistance and the interconnect capacitance of a write scan line and a video signal line, and show drive timings of the basic example shown in FIG. 6 with focus on uniformity along the horizontal direction of a screen.
Figure 9B:
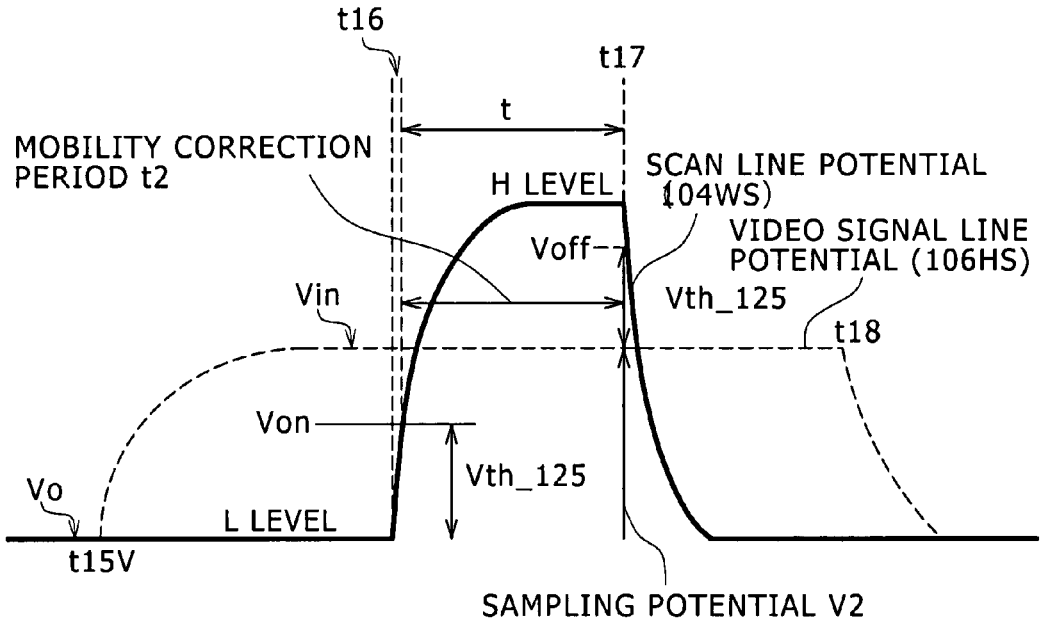
Figure 10A:
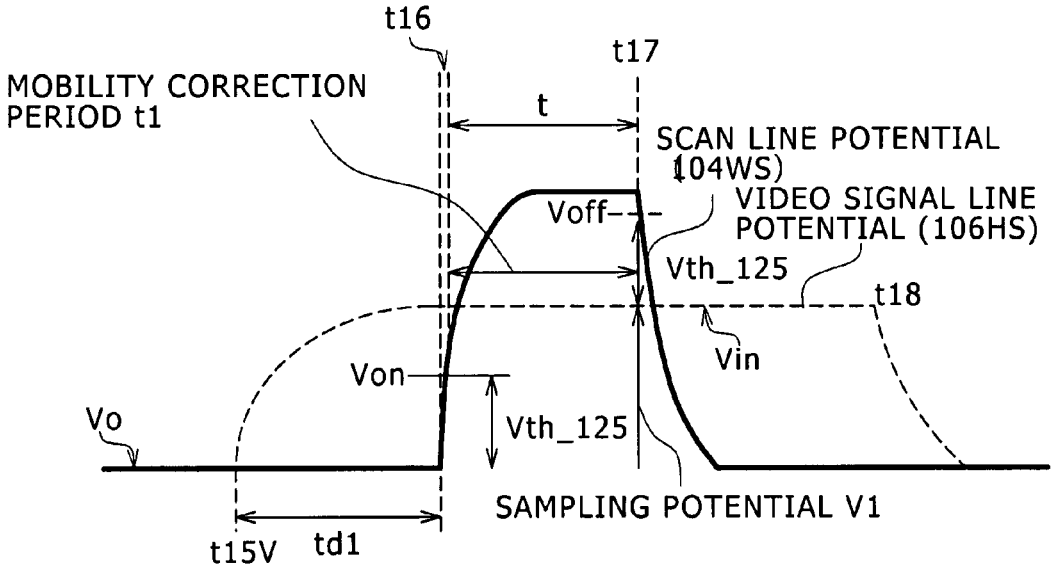
FIGS. 10A and 10B are schematic diagrams for explaining the relationship between a sampling period and mobility correction period and the interconnect resistance and the interconnect capacitance of a write scan line and a video signal line, and show drive timings of the basic example shown in FIG. 6 with focus on uniformity along the vertical direction of a screen.
Figure 10B:
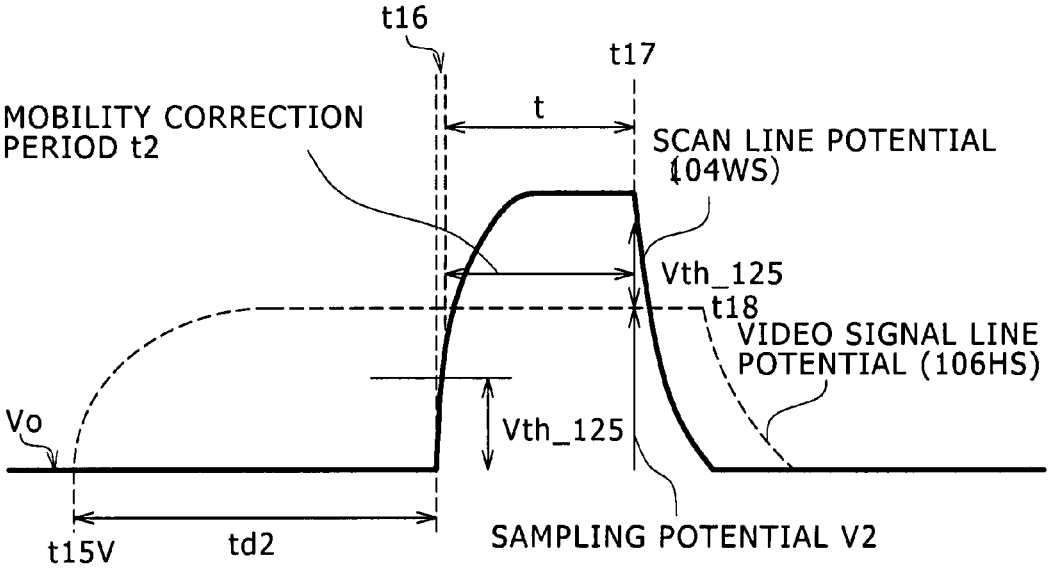

FIGS. 9 to 12 are schematic diagrams for explaining the relationship between the sampling period and mobility correction period H and the interconnect resistance and the interconnect capacitance of the write scan line 104WS and the video signal line 106HS. FIG. 9 shows the drive timings of the basic example shown in FIG. 6, with focus on uniformity along the horizontal direction of the screen. FIG. 10 shows the drive timings of the basic example shown in FIG. 6, with focus on uniformity along the vertical direction of the screen. FIG. 11 shows the drive timings of the above-described modification example of the basic example, with focus on uniformity along the horizontal direction of the screen. FIG. 12 shows modification examples with respect to FIG. 9. In the respective diagrams other than FIG. 12, A shows the relationship between the waveforms of the scan line potential and the video signal line potential about a remote-side pixel, and B shows that about a close-side pixel.

The waveform relationships in the respective diagrams are based on the following assumption. Specifically, the gate G of the sampling transistor 125 is connected to the write scan line 104WS from the write scanner 104. The drain D thereof is connected to the video signal line 106HS, and the source S thereof is coupled to the connecting node (node ND122) between the gate G of the drive transistor 121 and one terminal of the holding capacitor 120. Furthermore, as the sampling transistor 125, an enhancement-type transistor is used. In addition, the characteristic at the time of switching from OFF to ON is equivalent to that at the time of switching from ON to OFF, and a so-called Schmitt characteristic is ignored.

A discussion will be made about uniformity along the horizontal direction of the screen when the drive timings of the embodiment shown in FIG. 6 are employed. The write drive pulse WS is supplied from the write scanner 104 in common to all the pixel circuits P on one row. Therefore, as shown in FIG. 9, due to the influence of the interconnect capacitance and the interconnect resistance, the waveform corruption of the write drive pulse WS in the pixel circuit P remoter from the write scanner 104 (remote-side pixel) is larger than that in the pixel circuit P closer to the write scanner 104 (close-side pixel). In contrast, there is no difference in the waveform of the video signal line potential because the remote-side pixel and the close-side pixel are at the same distance from the horizontal driver 106 as the signal source.

In the remote-side pixel in which the waveform of the write drive pulse WS is considerably corrupted and deteriorated, although the on-timing of the sampling transistor 125 is shifted posteriorly compared with the close-side pixel, the off-timing is also shifted posteriorly. Consequently, the mobility correction period determined by the difference between the on-timing and the off-timing is substantially the same as that in the close-side pixel eventually.

Specifically, according to the drive timings of the basic example, the mobility correction period is determined by the overlapping range between the period during which the video signal line potential is the signal potential Vin and the active period of the write drive pulse WS. In particular, if the pulse width of the write drive pulse WS is set small so that the active period of the write drive pulse WS falls within the period during which the video signal line 106HS is at the signal potential Vin., the mobility correction periods t1 and t2 are determined by the width t of the active-H period of the write drive pulse WS eventually.

To be exact, the mobility correction period is equivalent to the period from the timing at which the sampling transistor 125 is turned on in response to the rising-up of the write drive pulse WS to the timing at which the sampling transistor 125 is turned off in response to the falling-down of the write drive pulse WS.

Basically, the sampling transistor 125 is turned on when the gate-source voltage Vgs_125 as the difference between the gate potential (the potential of the write drive pulse WS) and the source potential (the potential of the signal potential Vin) of the sampling transistor 125 just surpasses the threshold voltage Vth_125. In contrast, the sampling transistor 125 is turned off when the gate-source voltage Vgs_125 falls to below the threshold voltage Vth_125.

Therefore, as shown in FIG. 9, the on-timing is equivalent to the timing at which the gate potential of the sampling transistor 125, i.e., the potential of the write scan line 104WS, surpasses, after rising up from the L (low) level, the voltage (referred to as an on-voltage Von) arising from addition of the threshold voltage Vth_125 of the sampling transistor 125 to the source potential of the sampling transistor 125 at the timing, i.e., the reference potential Vo set in the gate of the sampling transistor 125 in the immediately previous writing and mobility correction preparation period G.

On the other hand, the off-timing of the sampling transistor 125 is equivalent to the timing at which the gate potential of the sampling transistor 125, i.e., the potential of the write scan line 104WS, falls down, after decreasing from the H (high) level, to below the voltage (referred to as an off-voltage Voff) arising from addition of the threshold voltage Vth_125 of the sampling transistor 125 to the source potential of the sampling transistor 125 after the sampling transistor 125 is turned on, i.e., the voltage (the signal potential Vin, in the present example) set in the gate of the sampling transistor 125 obtained by writing information corresponding to the signal potential Vin to the holding capacitor 120 in the sampling period and mobility correction period H.

Thus, as shown in the diagrams, the mobility correction period t1 is obtained in the remote-side pixel in which the waveform is considerably corrupted. On the other hand, the mobility correction period t2 is obtained in the close-side pixel in which the waveform is not considerably corrupted. In the remote-side pixel in which the waveform is considerably corrupted and deteriorated, although the on-timing of the sampling transistor 125 is shifted posteriorly compared with the close-side pixel, the off-timing is also shifted posteriorly. Consequently, the mobility correction period t1 in the remote-side pixel determined by the difference between the on-timing and the off-timing is substantially the same as the mobility correction period t2 in the close-side pixel eventually.

The signal dependent on the signal potential Vin (sampling potential) finally sampled in the holding capacitor 120 by the sampling transistor 125 is given depending on the video signal line potential when the sampling transistor 125 is just turned off. As is apparent from FIG. 9, in both the close-side pixel and the remote-side pixel, the sampled video signal potentials V1 and V2 have the level corresponding to the signal potential Vin (have the same level as that of the signal potential Vin, in the present example), and there is no difference therebetween.

In this manner, according to the drive timings of the basic example for the pixel circuit P of the present embodiment, there is almost no difference between the video signal potentials V1 and V2 sampled in the remote-side pixel and the close-side pixel. Furthermore, the difference between the mobility correction periods t1 and t2 in the remote-side pixel and the close-side pixel can also be ignored substantially. Thus, no luminance difference appears along the horizontal direction of the screen, and shading along the lateral direction (horizontal direction of the screen) attributed to the interconnect resistance and the interconnect capacitance of the write scan line 104WS and the video signal line 106HS is suppressed, which can realize a display offering a favorable image quality.

A discussion will be made about uniformity along the vertical direction of the screen. As shown in FIG. 10, there is no difference in the waveform of the write drive pulse WS (scan line potential waveform) between the pixel circuit P on the upper side of the screen (referred to as an upper-side pixel) and the pixel circuit P on the lower side of the screen (referred to as a lower-side pixel), because the upper-side pixel and the lower-side pixel are at the same distance from the write scanner 104. On the other hand, the video signal Vsig is supplied from the horizontal driver 106 via the video signal line 106HS in common to all the pixel circuits P on one column. Therefore, the lower-side pixel is equivalent to a remote-side pixel from the viewpoint of the horizontal driver 106, and the upper-side pixel is equivalent to a close-side pixel from the viewpoint of the horizontal driver 106.

Thus, due to the interconnect capacitance and the interconnect resistance of the video signal line 106HS, the amount of delay of the video signal voltage in the remote-side pixel remoter from the horizontal driver 106 is larger than that in the close-side pixel closer to the horizontal driver 106. As a result, the phase difference td1 between the video signal Vsig and the write drive pulse WS in the remote-side pixel remoter from the horizontal driver 106 is smaller than the phase difference td2 between the video signal Vsig and the write drive pulse WS in the close-side pixel closer to the horizontal driver 106.

However, even when the signal potential waveform appearing on the video signal line 106HS involves delay, almost no difference arises in the sampling potential and the mobility correction period as long as the active period of the write drive pulse WS falls within the period during which the video signal line 106HS is at the signal potential (the valid-period potential of the video signal Vsig). As a result, as is apparent from FIG. 10, between the lower side and the upper side of the screen, the sampled video signal potentials V1 and V2 are substantially the same, and the mobility correction periods t1 and t2 are also substantially the same. Thus, no luminance difference appears along the vertical direction of the screen, and shading along the vertical direction (upward and downward directions of the screen) attributed to the interconnect resistance and the interconnect capacitance of the write scan line 104WS and the video signal line 106HS is suppressed, which can realize a display offering a favorable image quality.

In the examples described with FIGS. 9 and 10, the drain D of the enhancement-type sampling transistor 125 is connected to the video signal line 106HS, and the source S is coupled to the connecting node (node ND122) between the gate G of the drive transistor 121 and one terminal of the holding capacitor 120. However, other forms also have substantially the same features as shown in the respective diagrams of FIG. 12, which are simple diagrams corresponding to FIG. 9.

Figure 12A:
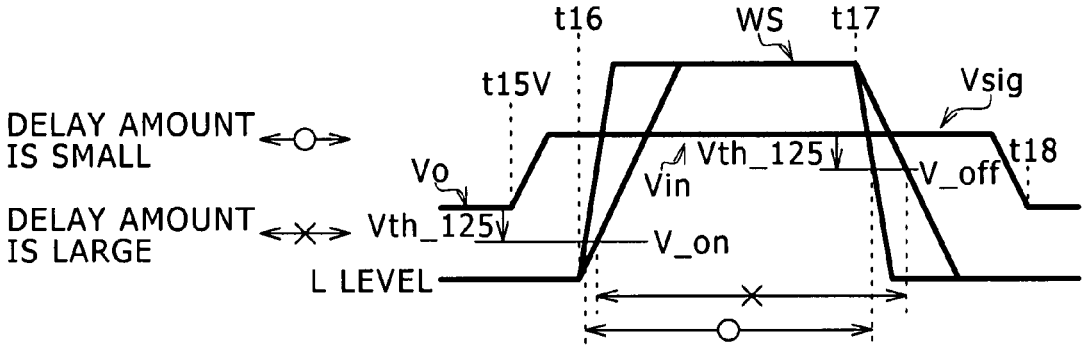
FIGS. 12A to 12C are schematic diagrams for explaining the relationship between a sampling period and mobility correction period and the interconnect resistance and the interconnect capacitance of a write scan line and a video signal line, and show modification examples of the configuration of FIG. 9.

For example, as shown in FIG. 12A, a depletion-type transistor may be used with the same connection form of the drain D and the source S. However, the voltage level of the write drive pulse WS supplied to the gate G of the sampling transistor 125 is so changed as to match the depletion-type transistor having a negative threshold voltage Vth_125.

In particular, in order to prevent current flow when the write drive pulse WS is at the L level, i.e., in order to surely keep the sampling transistor 125 at the off-state when the write drive pulse WS is at the L level, the L-level voltage of the write drive pulse WS is so set as to be lower than the voltage obtained by subtracting the threshold voltage Vth_125 (the absolute value thereof) from the reference potential Vo. Due to this setting, the on-timing is equivalent to the timing at which the gate potential of the sampling transistor 125, i.e., the potential of the write scan line 104WS, surpasses, after rising up from the L (low) level, the on-voltage Von arising from subtraction of the threshold voltage Vth_125 from the source potential of the sampling transistor 125 at the timing, i.e., the voltage (equivalent to the reference potential Vo, in the present example) set in the gate of the sampling transistor 125 in the immediately previous writing and mobility correction preparation period G.

On the other hand, the off-timing of the sampling transistor 125 is equivalent to the timing at which the gate potential of the sampling transistor 125, i.e., the potential of the write scan line 104WS, falls down, after decreasing from the H (high) level, to below the voltage (off-voltage Voff) arising from subtraction of the threshold voltage Vth_125 from the source potential of the sampling transistor 125 after the sampling transistor 125 is turned on, i.e., the voltage (the signal potential Vin, in the present example) set in the gate of the sampling transistor 125 obtained by writing information corresponding to the signal potential Vin to the holding capacitor 120 in the sampling period and mobility correction period H.

As described above, between the enhancement-type transistor having a positive threshold voltage Vth_125 and the depletion-type transistor having a negative threshold voltage Vth_125, there is no difference regarding the directions of the delays of the on-timing and the off-timing attributed to the difference in the influence of the interconnect resistance and the interconnect capacitance, although there is a difference only in the polarity relationship between the gate potential and the source potential at the on-timing and the off-timing of the sampling transistor 125.

Figure 12B:
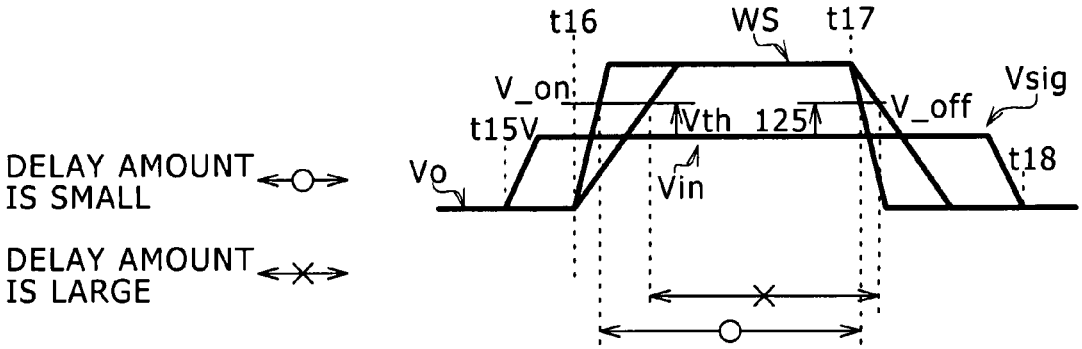

As shown in FIG. 12B, the connection form of the drain D and the source S of the sampling transistor 125 may be reversed. Specifically, the source S may be connected to the video signal line 106HS, and the drain D may be coupled to the connecting node (node ND122) between the gate G of the drive transistor 121 and one terminal of the holding capacitor 120.

In the case of FIG. 12B, in which the sampling transistor 125 is an enhancement-type transistor, the on-timing is equivalent to the timing at which the gate potential of the sampling transistor 125, i.e., the potential of the write scan line 104WS, surpasses, after rising up from the L (low) level, an on-voltage Von arising from addition of the threshold voltage Vth_125 to the source potential of the sampling transistor 125 at the timing, i.e., the signal potential Vin as the video signal line potential at the timing.

On the other hand, the off-timing of the sampling transistor 125 is equivalent to the timing at which the gate potential of the sampling transistor 125, i.e., the potential of the write scan line 104WS, falls down, after decreasing from the H (high) level, to below an off-voltage Voff arising from addition of the threshold voltage Vth_125 to the source potential of the sampling transistor 125 at the timing, i.e., the signal potential Vin as the video signal line potential at the timing. If the active period of the write drive pulse WS (t16 to t17) is so set as to surely fall within the period of the signal potential Vin (t15V to t18), the on-voltage Von and the off-voltage Voff are equivalent to each other.

When the connection form of the source S and the drain D of the sampling transistor 125 is thus reversed, the on-voltage Von is set with respect to the signal potential Vin, unlike the connection form shown in FIGS. 9 and 10, in which the on-voltage Von is set with respect to the voltage (the reference potential Vo, in these examples) set in the gate of the sampling transistor 125 in the writing and mobility correction preparation period G. However, there is no difference between these connection forms regarding the directions of the delays of the on-timing and the off-timing attributed to the difference of the influence of the interconnect resistance and the interconnect capacitance.

Figure 12C:
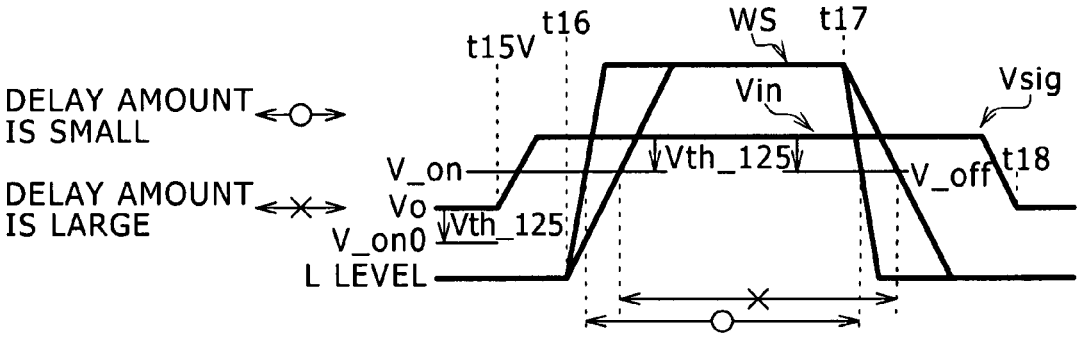

Furthermore, as shown in FIG. 12C, a configuration is also available in which the connection form of the drain D and the source S of the sampling transistor 125 is reversed and a deletion-type transistor is used as the sampling transistor 125. In this configuration, the voltage level of the write drive pulse WS is so changed as to match the depletion-type transistor having a negative threshold voltage Vth_125. In particular, in order to prevent current flow when the write drive pulse WS is at the L level, i.e., in order to surely keep the sampling transistor 125 at the off-state when the write drive pulse WS is at the L level, the L-level voltage of the write drive pulse WS is so set as to be lower than the voltage (referred to as an on-voltage Von0) obtained by subtracting the threshold voltage Vth_125 (the absolute value thereof) from the reference potential Vo. There is no difference from the enhancement-type transistor regarding the directions of the delays of the on-timing and the off-timing attributed to the difference in the influence of the interconnect resistance and the interconnect capacitance.

On the other hand, according to the drive timings of the modification example, the mobility correction period is determined by the phase difference between the potential of the write scan line 104WS and the potential of the video signal line 106HS. Therefore, the sampling period and mobility correction period H is affected by the difference in the waveform characteristic attributed to the influence of the dependency of the interconnect resistance and the interconnect capacitance of the write scan line 104WS and the video signal line 106HS upon the distance.

Specifically, according to the drive timings of the modification example, the start timing of the mobility correction period is defined by the rising-up timing of the signal potential Vin. In contrast, the stop timing of the mobility correction period is defined by the end of the overlapping range between the active period of the write drive pulse WS and the period during which the video signal line potential is the signal potential Vin. To be exact, the stop timing of the mobility correction period is equivalent to the timing at which the sampling transistor 125 is turned off in response to the falling-down of the write drive pulse WS.

Figure 11A:
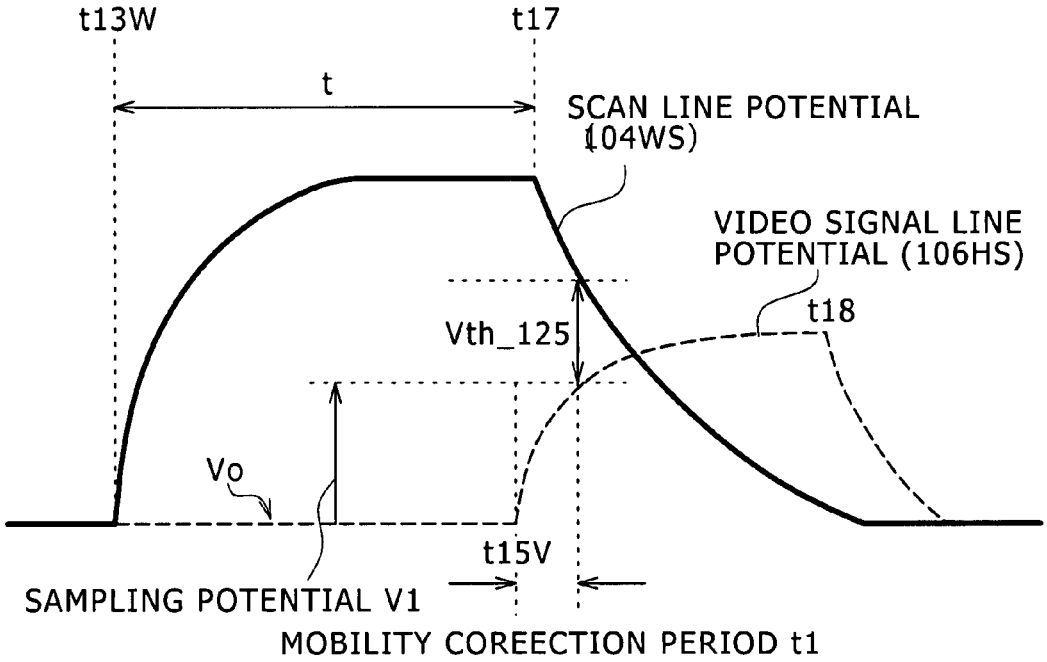
FIGS. 11A and 11B are is a schematic diagram for explaining the relationship between a sampling period and mobility correction period and the interconnect resistance and the interconnect capacitance of a write scan line and a video signal line, and show drive timings of a modification example of the basic example shown in FIG. 6 with focus on uniformity along the horizontal direction of a screen.
Figure 11B:
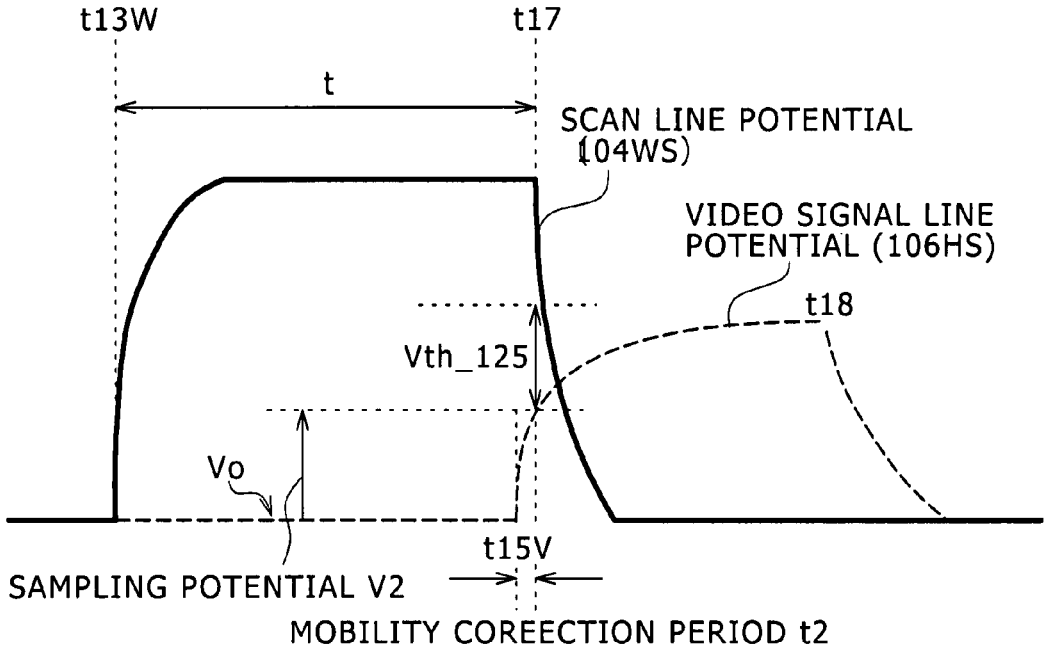

Specifically, as shown in FIGS. 11A to 11B are, the off-timing of the sampling transistor 125 is equivalent to the timing at which the difference Vgs_125 between the gate potential (the potential of the write drive pulse WS) and the source potential (the potential of the signal potential Vin) of the sampling transistor 125 just falls to below the threshold voltage Vth_125.

In the configuration yielding the waveforms shown in FIGS. 11A to 11B are, the drain D of the sampling transistor 125 is connected to the video signal line 106HS, and the source S thereof is coupled to the connecting node (node ND122) between the gate G of the drive transistor 121 and one terminal of the holding capacitor 120. Furthermore, as the sampling transistor 125, an enhancement-type transistor is used.

A discussion will be made about uniformity along the horizontal direction of the screen. As shown in FIGS. 11A to 11B are, in a close-side pixel, the potential of the write scan line 104WS (i.e., the write drive pulse WS) is not deteriorated because the interconnect resistance and the interconnect capacitance of the write scan line 104WS are low. In contrast, in a remote-side pixel, the potential of the write scan line 104WS (i.e., the write drive pulse WS) is considerably corrupted and deteriorated because the interconnect resistance and the interconnect capacitance of the write scan line 104WS are high. On the other hand, as for the video signal potential, the difference in pulse deterioration is small because the remote-side pixel and the close-side pixel are at the same distance from the horizontal driver 106 as the supply source of the video signal.

Because the waveform deterioration of the potential of the write scan line 104WS is different between the close side and the remote side of the screen, there is a difference between the video signal potentials V1 and V2 sampled in the holding capacitor 120 in the remote-side pixel and the close-side pixel. Furthermore, there is a difference also between the mobility correction periods t1 and t2 in the remote-side pixel and the close-side pixel. On the remote side of the screen, the waveform deterioration of the write drive pulse WS is significant, which yields a tendency that the sampling potential V1 is high and the mobility correction period t1 is long. In contrast, on the close side of the screen, almost no waveform deterioration occurs in the write drive pulse WS, and therefore both the sampling potential V2 and the mobility correction period t2 have values close to designed values.

As described above, according to the drive timings of the modification example, the sampling potential and the mobility correction period will differ between the close-side pixel closer to the write scanner 104 on the screen and the remote-side pixel remoter from the write scanner 104 on the screen (i.e., between the left and right sides of the screen). These differences yield luminance differences along the horizontal direction of the screen, and these luminance differences are visually recognized as shading.

The features described with FIG. 11 relate to a configuration in which the drain D of the enhancement-type sampling transistor 125 is connected to the video signal line 106HS, and the source S is coupled to the connecting node (node ND122) between the gate G of the drive transistor 121 and one terminal of the holding capacitor 120. However, although illustration is omitted, other forms similar to those shown in FIG. 12, which relate to the drive timings of the basic example, also have substantially the same features.

As described above, according to the drive timings of the modification example, the relative phase difference between the signal potential Vin and the write drive pulse WS (one example of write-and-initialization scan pulses) is adjusted. In contrast, according to the drive timings of the basic example shown in FIG. 6, the write drive pulse WS is kept active at a predetermined position in the period during which the signal potential Vin is supplied to the video signal line 106HS, and for a period shorter than the supply period of the signal potential Vin. As is apparent from the comparison between the basic and modification examples, in terms of the relationship of the interconnect resistance and the interconnect capacitance of the write scan line 104WS and the video signal line 106HS during the sampling period and the mobility correction period, the basic example allows the mobility correction period to be adjusted more accurately without the influence of the interconnect resistance and the interconnect capacitance, and hence is superior in the anti-shading property, compared with the modification example.

That is, the drive timings of the basic example shown in FIG. 6 are superior if the following scheme is employed. Specifically, after threshold correction operation, mobility correction operation of adding a voltage for correction of the mobility of the drive transistor 121 to information written to the holding capacitor 120 is carried out simultaneously with sampling operation of writing information corresponding to the signal potential Vin to the holding capacitor 120 by turning on the sampling transistor 125. Furthermore, the rising edge of the video signal Vsig at the time of switching from the reference potential Vo to the signal potential Vin is provided with a slope, to thereby allow the mobility correction period to automatically follow the level of the signal potential Vin.

While a preferred embodiment of the present invention has been described using specific terms, such description is for illustrative purpose only, and it is to be understood that changes and variations may be made without departing from the spirit or scope of the following claims.

What is claimed is:

1. A display comprising:

a pixel array part configured to include pixel circuits arranged in a matrix, each of the pixel circuits having a drive transistor that produces a drive current, a holding capacitor connected between a control input terminal and an output terminal of the drive transistor, an electro-optical element connected to the output terminal of the drive transistor, a sampling transistor that writes information corresponding to a signal potential of a video signal supplied via a video signal line to the holding capacitor, and an initialization transistor that has an output terminal coupled to a connecting node between the holding capacitor and the output terminal of the drive transistor and initializes a potential of the output terminal of the drive transistor, a drive current based on information held in the holding capacitor being produced by the drive transistor and being applied to the electro-optical element for light emission of the electro-optical element; and a controller configured to include a write scanner and a horizontal driver, the write scanner sequentially controlling the sampling transistors with a horizontal cycle to thereby carry out line-sequential scanning of the pixel circuits and writing information corresponding to a signal potential of a video signal to each of the holding capacitors on one row, the horizontal driver supplying video signals for one row to the video signal lines in matching with the line-sequential scanning by the write scanner, wherein the controller implements control for execution of threshold correction operation for holding a voltage equivalent to a threshold voltage of the drive transistor in the holding capacitor by keeping the initialization transistor at a non-conductive state and keeping the sampling transistor at a conductive state in a time zone during which the signal potential is supplied to the sampling transistor, and the threshold correction operation is executed after potentials of the control input terminal and the output terminal of the drive transistor are initialized by keeping the sampling transistor and the initialization transistor at a conductive state in a time zone during which a predetermined initialization potential is supplied to the sampling transistor and the initialization transistor.

2. The display according to claim 1, wherein the controller implements control for repeated execution of the threshold correction operation in a plurality of periods having a cycle of one horizontal period and each preceding writing of the signal potential to the holding capacitor.

3. The display according to claim 1, wherein the controller adds information for correction of a mobility of the drive transistor to information written to the holding capacitor after the threshold correction operation.

4. The display according to claim 3, wherein the controller adds information for correction of a mobility of the drive transistor to information written to the holding capacitor in writing of information corresponding to the signal potential to the holding capacitor through keeping of the sampling transistor at a conductive state in a time zone during which the signal potential is supplied to the sampling transistor after the threshold correction operation.

5. The display according to claim 4, wherein the controller generates a write-and-initialization scan pulse for keeping the sampling transistor at a conductive state for a period that falls within a time zone during which the signal potential is supplied to the sampling transistor and is shorter than the time zone.

6. The display according to claim 5, wherein the controller is configured to allow adjustment of a width of the write-and-initialization scan pulse.

7. The display according to claim 4, wherein the controller is configured to allow adjustment of a relative phase difference between the signal potential and the write-and-initialization scan pulse.

8. The display according to claim 3, wherein the horizontal driver gives a slope to a rising edge of a potential of the video signal line at the time of switching of the potential to the signal potential to thereby cause a period for correcting a mobility of the drive transistor to follow a level of the signal potential.

9. The display according to claim 1, wherein the controller stops supply of the video signal to the control input terminal of the drive transistor by turning the sampling transistor to a non-conductive state at a timing when information corresponding to the signal potential has been written to the holding capacitor, to thereby allow operation in which a potential of the control input terminal of the drive transistor changes in linkage with change in a potential of the output terminal of the drive transistor.

10. The display according to claim 1, wherein the controller turns the sampling transistor to a non-conductive state after turning the sampling transistor to a conductive state in a state in which the signal potential is supplied to the sampling transistor, to thereby keep constant a difference between potentials of the control input terminal and the output terminal of the drive transistor.

11. The display according to claim 1, wherein the controller continuously keeps the sampling transistor at a non-conductive state in a period during which a drive current based on information held in the holding capacitor flows through the electro-optical element.

12. A display comprising:

a pixel array part configured to include pixel circuits arranged in a matrix, each of the pixel circuits having a drive transistor that produces a drive current, a holding capacitor connected between a control input terminal and an output terminal of the drive transistor, an electro-optical element connected to the output terminal of the drive transistor, a sampling transistor that writes information corresponding to a signal potential of a video signal supplied via a video signal line to the holding capacitor and initializes a potential of the control input terminal of the drive transistor based on a predetermined initialization potential, and an initialization transistor that initializes a potential of the output terminal of the drive transistor based on the predetermined initialization potential, a drive current based on information held in the holding capacitor being produced by the drive transistor and being applied to the electro-optical element for light emission of the electro-optical element; and a controller configured to include a write scanner, a horizontal driver, and an initialization scanner, the write scanner sequentially controlling the sampling transistors with a horizontal cycle to thereby carry out line-sequential scanning of the pixel circuits and outputting a write-and-initialization scan pulse for writing information corresponding to a signal potential of a video signal to each of the holding capacitors on one row and initializing a potential of the control input terminal of the drive transistor, the horizontal driver supplying video signals for one row to the video signal lines in matching with the line-sequential scanning by the write scanner, the initialization scanner outputting an initialization scan pulse for controlling each of the initialization transistors on one row in matching with the line-sequential scanning by the write scanner.

13. The display according to claim 12, wherein an input terminal of the initialization transistor is connected to the video signal line and an output terminal of the initialization transistor is coupled to a connecting node between the holding capacitor and the output terminal of the drive transistor, and the initialization scan pulse from the initialization scanner is supplied to a control input terminal of the initialization transistor.

14. The display according to claim 12, wherein the controller stops supply of the video signal to the control input terminal of the drive transistor by turning the sampling transistor to a non-conductive state at a timing when information corresponding to the signal potential has been written to the holding capacitor, to thereby allow operation in which a potential of the control input terminal of the drive transistor changes in linkage with change in a potential of the output terminal of the drive transistor.

15. The display according to claim 13, wherein the horizontal driver switches a potential of the video signal between the predetermined initialization potential and the signal potential and supplies the video signal to the sampling transistor and the initialization transistor via the video signal line.

16. The display according to claim 15, wherein the controller implements control for execution of preparation operation for threshold correction operation for holding a voltage equivalent to a threshold voltage of the drive transistor in the holding capacitor, and the preparation operation is to initialize, previously to the threshold correction operation, potentials of the control input terminal and the output terminal of the drive transistor by keeping the sampling transistor and the initialization transistor at a conductive state in a time zone during which an initialization potential of the video signal is supplied to the sampling transistor and the initialization transistor.

17. The display according to claim 15, wherein the controller implements control for execution of threshold correction operation for holding a voltage equivalent to a threshold voltage of the drive transistor in the holding capacitor by keeping the sampling transistor at a conductive state and keeping the initialization transistor at a non-conductive state in a time zone during which a reference potential of the video signal is supplied to the sampling transistor.

18. A pixel circuit comprising:

a drive transistor configured to produce a drive current;

a holding capacitor configured to be connected between a control input terminal and an output terminal of the drive transistor;

an electro-optical element configured to be connected to the output terminal of the drive transistor;

a sampling transistor configured to write information corresponding to a signal potential of a video signal supplied via a video signal line to the holding capacitor and initialize a potential of the control input terminal of the drive transistor based on a predetermined initialization potential; and an initialization transistor configured to initialize a potential of the output terminal of the drive transistor based on the initialization potential, wherein an input terminal of the initialization transistor is connected to the video signal line and an output terminal of the initialization transistor is coupled to a connecting node between the holding capacitor and the output terminal of the drive transistor, and an initialization scan pulse is supplied to a control input terminal of the initialization transistor.

19. A method for driving a pixel circuit including a drive transistor that produces a drive current, a holding capacitor connected between a control input terminal and an output terminal of the drive transistor, an electro-optical element connected to the output terminal of the drive transistor, a sampling transistor that writes information corresponding to a signal potential of a video signal supplied via a video signal line to the holding capacitor, and an initialization transistor that has an output terminal coupled to a connecting node between the holding capacitor and the output terminal of the drive transistor and initializes a potential of the output terminal of the drive transistor, a drive current based on information held in the holding capacitor being produced by the drive transistor and being applied to the electro-optical element for light emission of the electro-optical element, the method comprising the step of implementing control for execution of threshold correction operation for holding a voltage equivalent to a threshold voltage of the drive transistor in the holding capacitor by keeping the initialization transistor at a non-conductive state and keeping the sampling transistor at a conductive state in a time zone during which the signal potential is supplied to the sampling transistor, after initializing potentials of the control input terminal and the output terminal of the drive transistor by keeping the sampling transistor and the initialization transistor at a conductive state in a time zone during which a predetermined initialization potential is supplied to the sampling transistor and the initialization transistor.

* * * * *